US006526250B1

(12) United States Patent
Usui et al.

(10) Patent No.: US 6,526,250 B1
(45) Date of Patent: Feb. 25, 2003

(54) TRANSFER FIXING DEVICE, IMAGE BEARING AND CONVEYING BODY, AND IMAGE FORMING APPARATUS WITH PLURAL GLOSS PROCESSING

(75) Inventors: Satoshi Usui, Nakai-machi (JP); Kiyotaka Ishikawa, Nakai-machi (JP); Nobuyuki Kato, Nakai-machi (JP); Kouichirou Shinohara, Nakai-machi (JP)

(73) Assignee: Fuji Xerox Xo., Ltd., Tokyo (JP)

( * ) Notice: Subject to any disclaimer, the term of this patent is extended or adjusted under 35 U.S.C. 154(b) by 0 days.

(21) Appl. No.: 09/650,672

(22) Filed: Aug. 30, 2000

(30) Foreign Application Priority Data

Nov. 26, 1999 (JP) ..... 11-335396

(51) Int. Cl.[7] ..... G03G 15/16
(52) U.S. Cl. ..... 399/307
(58) Field of Search ..... 399/67, 307, 329

(56) References Cited

U.S. PATENT DOCUMENTS

| | | | | | |
|---|---|---|---|---|---|
| 5,019,869 | A | * | 5/1991 | Patton | 399/320 |
| 5,026,276 | A | * | 6/1991 | Hirabayashi et al. | 432/59 |
| 5,085,962 | A | * | 2/1992 | Aslam et al. | 430/99 |
| 5,086,209 | A | * | 2/1992 | Kintz et al. | 219/216 |
| 5,920,756 | A | * | 7/1999 | Matsuda et al. | 399/307 |

FOREIGN PATENT DOCUMENTS

| | | | | |
|---|---|---|---|---|
| JP | 63-92965 | A | | 4/1988 |
| JP | 63-50711 | B2 | | 10/1988 |
| JP | 65-698 | B2 | | 1/1989 |
| JP | 2-61749 | B2 | | 12/1990 |
| JP | 5-173448 | A | | 7/1993 |
| JP | 7-49662 | A | | 2/1995 |
| JP | 9-197763 | | * | 7/1997 |
| JP | 10-63028 | A | | 3/1998 |
| JP | 11-24430 | A | | 1/1999 |
| JP | 11-52760 | A | | 2/1999 |
| JP | 11-52760 | | * | 2/1999 |

* cited by examiner

*Primary Examiner*—Quana M. Grainger
(74) *Attorney, Agent, or Firm*—Morgan, Lewis & Bockius LLP

(57) ABSTRACT

In this invention, even if a thick resin coated recording medium having large heat capacity is used, a high quality image with an excellent gloss feeling is obtained. A transfer fixing device is provided with a press conveying mechanism which includes at least one pair of pressing bodies for nipping and conveying an image bearing and conveying body and a recording medium, and contact-conveys the recording medium on the image bearing and conveying body in a region exceeding a nip region of the pair of pressing bodies, and a heat supply adjusting mechanism which includes a heating source for heating the recording medium contact-conveyed on the image bearing and conveying body by the press conveying mechanism from both obverse and reverse sides to melt an unfixed image and a thermoplastic resin layer, and makes adjustment to cause heat supplied to an image bearing surface side of the recording medium to be more than heat supplied to a non-image bearing surface side of the recording medium. Besides, transferring and fixing is performed by a heating and pressing mechanism after a preheating mechanism. Further, the image bearing and conveying body having plural different gloss surfaces is provided. Moreover, an image forming apparatus using these is also provided.

3 Claims, 19 Drawing Sheets

TRANSFER FIXING DEVICE, IMAGE BEARING AND CONVEYING BODY, AND IMAGE FORMING APPARATUS WITH PLURAL GLOSS PROCESSING

BACKGROUND OF THE INVENTION

1. Field of the Invention

The present invention relates to a transfer fixing device for transferring and fixing an unfixed image (toner image etc.) formed on an image bearing and conveying body such as an intermediate transfer belt onto a recording medium, the image bearing and conveying body, and an image forming apparatus, and particularly to an improvement of a transfer fixing device, an image bearing and conveying body, and an image forming apparatus, which are effective when a recording medium provided with a thermoplastic resin layer on its surface is used.

2. Description of the Related Art

In recent years, with the development of a computer and the improvement of a network or the like, and the popularization of a scanner, digital camera, or the like in addition to the appearance of a mass storage medium, photo-like image data have been rapidly spread and a demand to print out these image data with high picture quality has been increased. Particularly, a demand to improve the picture quality by putting a gloss on a full color image has been increased.

On the other hand, in an image forming apparatus such as a copying machine of an electrophotographic system or the like, a printer, or a facsimile, as a transferring and simultaneous fixing system in which transferring and fixing are simultaneously carried out by instananeously heating and pressing a toner image has been technically investigated, it has been attempted to increase the speed of image formation.

Here, as this kind of transfer fixing device, for example, there is widely known a device in which a toner image is formed on an image bearing formation body such as a photoreceptor drum, the toner image is transferred onto an image bearing and conveying body such as an intermediate transfer belt, and then, instantaneous heat and pressure is imparted to the toner image on the intermediate transfer belt by a heating roll and a pair of pressure rolls, so that the toner image is transferred and simultaneously fixed onto a recording medium.

However, the toner image does not entirely permeate a paper sheet as a general recording medium, but is formed to be swelled on the recording medium. Thus, in a halftone region or highlight region, the structures of line screen or dot screen are swelled and are unevenly swelled from the recording medium, so that scattering of incident light becomes high. In the case where a picture image having relatively high concentration gradation, such as a figure image, is formed, the picture image in which a high glossy region and a low glossy region are mixed, is obtained and gives a feeling of wrongness. Further, in such a rough picture image, color reproducibility is lowered by the influence of diffused reflection on the surface of the picture image, and it becomes a picture image with low vividness.

As a method for solving such a technical problem, there is already disclosed a method in which a transparent resin layer is provided on a recording medium, a toner is transferred onto the recording medium, and then, the toner is embedded into the transparent resin layer by a roll heat fixing machine (for example, Japanese Patent Unexamined Publication No. Sho. 63-92965), or a method in which a thermoplastic transparent resin layer is provided on a recording medium, and the transparent resin having the softening point (Tmp) within the range from +10° C. to −30° C. with respect to the softening point (Tmt) of the toner is used, so that a picture image superior in image gloss and color reproducibility, without formation of irregular color, superior in graininess, and superior in uniformity of image gloss is obtained (for example, Japanese Patent Unexamined Publication No. Hei. 10-63028).

However, even if this kind of recording medium, that is, the recording medium having the uppermost layer covered with the resin layer in which toner is embedded is used, and the toner image is transferred and fixed by the foregoing transfer fixing device, when the transferring/fixing speed, that is, the moving speed of the intermediate transfer belt is increased, heat supply to the toner image and the thermoplastic resin layer is not sufficiently performed and becomes insufficient. As a result, the toner image comes not to sink into the thermoplastic resin layer, so that the surface smoothness of the picture image formed on the surface of the recording medium is lowered, and image irregularity or minute gloss irregularity becomes liable to occur. Particularly, in the halftone region, since heat supply to the thermoplastic resin layer through the toner becomes insufficient, there is seen a phenomenon in which the influence remarkably appears.

In order to avoid such a state, in the foregoing transfer fixing device, even if a method of raising the temperature of the heating roll for supplying heat to the toner image and the thermoplastic resin layer is used, in the case where fixing is made at high speed, since a time when the thermoplastic resin layer of the recording medium is in contact with the heating roll is short, a rise in heat supply quantity becomes slight, the thermoplastic resin layer is not sufficiently melted, and sinking of the toner image is not improved. If the temperature of the heating roll is excessively raised, there is also a fear that toner is excessively melted and a hot offset occurs.

Then, there is proposed a technique in which a recording medium is preheated before transferring and fixing, and a thermoplastic resin layer of the recording medium is made sufficiently melted at the time of the transferring and fixing, so that the degree of sinking of a toner image is improved even at high speed.

Conventionally, as this kind of preheating system, there is known an image forming apparatus in which a toner image on an image bearing formation body is once pressed and transferred onto an intermediate transfer belt, and this is transferred onto a recording medium at a transfer fixing portion formed of a heating roll and a pressure roll and is simultaneously heated and fixed, and in which a heating body such as a plate-like heating member is disposed to be close to or in contact with the pressure roll, and the recording medium is made to go into the transfer fixing portion while being heated by the hating body such as the plate-like heating member (for example, see Japanese Patent Publication No. Sho. 64-698, No. Hei. 2-61749).

However, in the prior art of this kind, since the heating body such the plate-like heating member is provided in a recording medium conveying passage and the recording medium is preheated by this heating body, there is a fear that in the resin coated recording medium, the surface resin layer adheres to a guide shoot of the recording medium conveying passage or the like to increase conveying resistance, a jam or the like occurs, and it becomes impossible to convey the recording medium.

There is also proposed a method in which the foregoing heating body is not used, but a recording medium is guided to a press contact position along a peripheral surface of a heating roll by a guide member (see Japanese Patent Publication No. Sho. 63-50711). However, this method has a similar technical problem in that the preheated and melted surface resin layer is liable to adhere to the guide member.

As a non-contact type preheating system, it is conceivable to heat a recording medium by light of a halogen lamp or the like (for example, Japanese Patent Unexamined Publication No. Hei. 5-173448). However, since the recording medium is white or transparent, the light absorption efficiency is very poor in a normal system, and it is not practical.

If an industrial hot air heater used for film weld or the like is employed as it is, there occurs a technical problem of poor running of a recording medium due to curl of the recording medium, partial adhesion of the surface resin layer, or the like.

On the other hand, there is disclosed a method in which in order to secure a sufficient transferring/fixing time at high speed transferring/fixing, a heating endless belt is used instead of the heating roll (for example, Japanese Patent Unexamined Publication No. Hei. 7-49622).

In this method, the heating endless belt is disposed to come in contact with an intermediate transfer belt in a wide range, a recording medium is made to pass between the intermediate transfer belt and the heating endless belt, and a toner image on the intermediate transfer belt is transferred and fixed onto the recording medium by using the heating endless belt, so that a sufficient transferring/fixing time is secured even at high speed.

However, in this type of transfer fixing device, since heating can be made only from the reverse side (non-image bearing surface side) of the recording medium, in order to supply heat sufficient to melt the toner image and the thermoplastic resin layer, it is necessary to heat the heating endless belt to a high temperature.

In this case, since the temperature of the thermoplastic resin layer becomes higher than, the toner temperature, in the case where the set temperature of the heating endless belt is high, the thermoplastic resin layer is excessively melted, and the toner is diffused, so that the sharpness of a picture image is deteriorated, or the melting viscosity of the surface resin layer of the recording medium is excessively lowered, so that poor peeling becomes liable to occur. If the set temperature of the heating endless belt is made low, the toner comes not to be melted sufficiently, and there occurs a technical problem that a coloring property becomes poor.

As a method of solving such technical problems, there is proposed a technique in which an image forming apparatus is provided with such a transfer fixing device that an image bearing and conveying body (for example, an intermediate transfer belt) for bearing and conveying an unfixed toner image is disposed to come in contact with a recording medium provided with a thermoplastic resin layer on its surface, and the unfixed toner image on the image bearing and conveying body is made to be transferred and fixed onto the thermoplastic resin layer of the recording medium, and in which the transfer fixing device includes at least three rolls for heating and pressing the toner image nipped between the image bearing and conveying body and the recording medium, and at least two rolls of these rolls are disposed at positions where they nip the image bearing and conveying body, the toner image, and the recording medium therebetween, and are in contact with the remaining one roll (for example, see Japanese Patent Unexamined Publication No. Hei. 11-52760).

By this, even if transferring and fixing is performed at high speed, the gloss of the surface of a picture image is high, and the occurrence of minute gloss irregularity is prevented.

However, in the transfer fixing device of the prior art, there has been found such a technical problem that since the reverse side of the recording medium is also heated to the same degreed as the obverse side, when the recording medium is continuously made to pass in a continuous print mode or the like, the temperature of the reverse surface of the recording medium is raised, and a so-called blister phenomenon in which moisture in the inside of the recording medium is transformed into bubbles occurs, which causes a picture quality defect.

Besides, in the conventional image forming apparatus of the transferring and simultaneous fixing system, there is also such a technical problem that since the surface state of the image bearing and conveying body such as the intermediate transfer belt is normally formed to be uniform, a formed image is inevitably limited to one gloss, and it is difficult to obtain a gloss desired by the user.

There is an example in which in order to improve the quality of a projection image for an OHP sheet, the surface of an image bearing and conveying body is divided into one for a plain paper and one for the OHP sheet (for example, see Japanese Patent Unexamined Publication No. Hei. 11-24430). In this example, transmission linearity of light to the OHP sheet is considered, and particularly, there is a factor of total reflection which the user does not desire relatively, so that it is unsatisfactory in the meaning of selecting the gloss desired by the user.

SUMMARY OF THE INVENTION

The present invention has been made in view of the above circumstances and provides a transfer fixing device, an image bearing and conveying body, and an image forming apparatus, in which a picture image with an excellent gloss can be obtained even if a thick resin coated recording medium with high heat capacity is used.

More specifically, a first aspect of the present invention provides a transfer fixing device and an image forming apparatus in which even if a thick resin coated recording medium with high heat capacity is used and transferring/fixing is performed at high speed, a fixed image sinks sufficiently into a thermoplastic resin layer of the recording medium and plane smoothness of the fixed image is secured, and high picture quality without defects in picture quality, such as a blister phenomenon, can be maintained.

A second aspect of the present invention provides an image bearing and conveying body and an image forming apparatus in which even if a thick resin coated recording medium with high heat capacity is used, a gloss desired by a user can be easily obtained.

BRIEF DESCRIPTION OF THE DRAWINGS

Preferred embodiments of the present invention will be described in detail based on the following figures, wherein.

DETAILED DESCRIPTION OF THE PREFERRED EMBODIMENTS

The present invention will be described below in detail based on embodiments shown in the accompanying drawings.

Before describing the embodiments, basic configurations of the first and second aspects of the present invention are explained.

Figure 1:
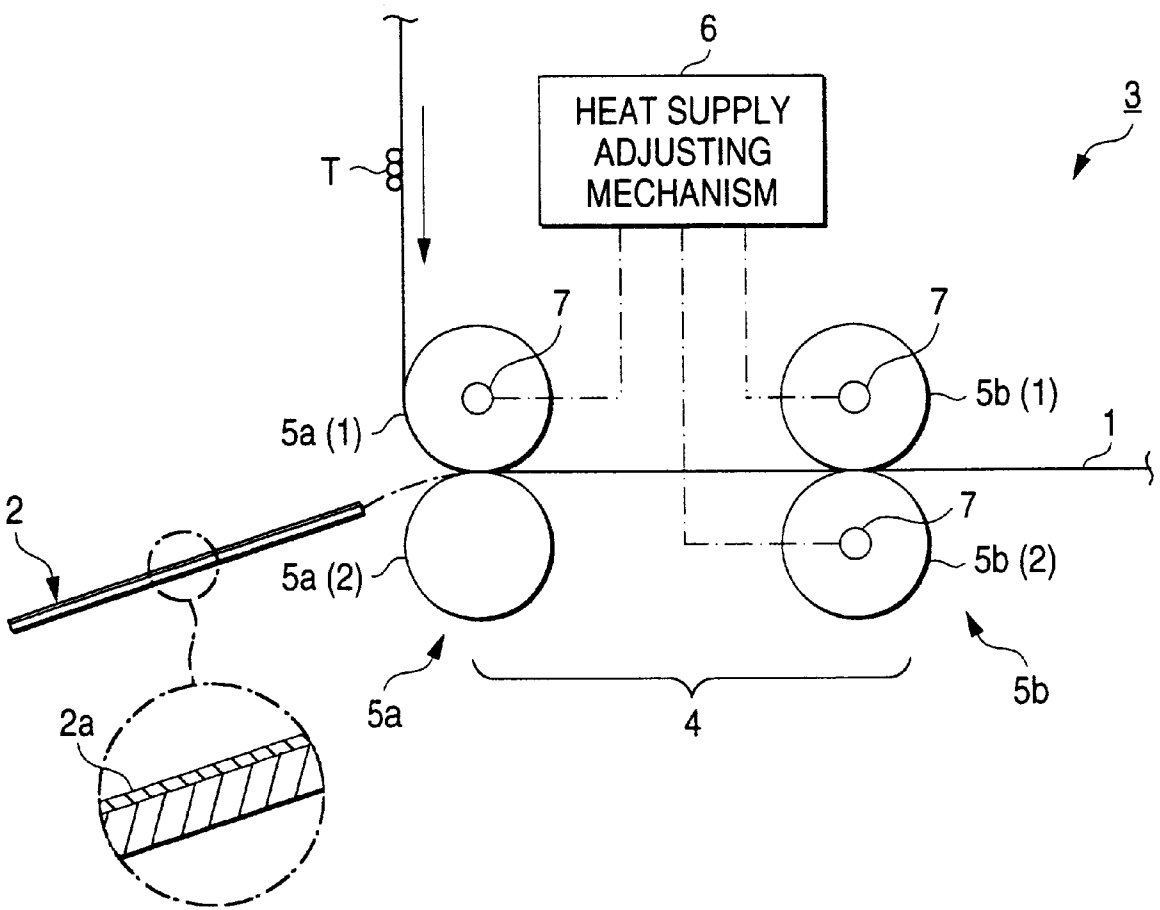
FIG. 1 is an explanatory view showing an outline of a transfer fixing device and an image forming apparatus of the present invention.

According to the first aspect of the present invention, as shown in FIG. 1, in a transfer fixing device 3 in which an image bearing and conveying body 1 for bearing and conveying an unfixed image (for example, an unfixed toner image) T is disposed to come in contact with a recording medium 2 provided with a thermoplastic resin layer 2*a* on its surface, and the unfixed image T on the image bearing and conveying body 1 is transferred and fixed into the thermoplastic resin layer 2*a* of the recording medium 2, the transfer fixing device is characterized by including a press conveying mechanism 4 which includes at least one pair of pressing bodies 5 for nipping and conveying the image bearing and conveying body 1 and the recording medium 2 and contact-conveys the recording medium 2 on the image bearing and conveying body 1 in a region exceeding a nip region of the pair of pressing bodies 5, and a heat supply adjusting mechanism 6 which includes a heating source 7 for heating the recording medium 2 contact-conveyed on the image bearing and conveying body 1 by the press conveying mechanism 4 from both obverse and reverse sides to melt the unfixed image T and the thermoplastic resin layer 2*a*, and makes adjustment to cause heat supplied to an image bearing surface side of the recording medium 2 to be more than heat supplied to a non-image bearing surface side of the recording medium 2.

In such technical constitution, as the image bearing and conveying body 1, as long as the unfixed image T is born and conveyed, it may be an image bearing formation body or an intermediate transfer belt. Besides, as to its shape, although a belt shape is normally used, since a drum shape can also be used, the invention is not limited to the belt shape.

Although the recording medium 2 may be of a multi-layer structure, it is presupposed that at least the uppermost layer is the thermoplastic resin layer 2*a*.

Besides, as the press conveying mechanism 4, at least one pair of pressing bodies 5 has only to be provided. In view of conveying properties of the image bearing and conveying body 1 and the recording medium 2, although it is preferable that the pressing body 5 has a roll shape, the invention is not necessarily limited to the roll shape.

As a typical mode of the press conveying mechanism 4, there is cited one in which plural pairs of pressing bodies 5 (for example, 5*a*, 5*b*) are disposed at front and rear different positions in the conveying direction of the image bearing and conveying body 1. In addition to this, there is cited a combination of one pair of pressing bodies 5 and a facing body (not shown) disposed to face the one pressing body.

Besides, as the press conveying mechanism 4, from the viewpoint of causing heat supply from the side of the image bearing and conveying body 1 to be large, a contact region with the image bearing and conveying body 1 longer than a nip region of the pressing bodies 5 has only to be provided.

Further, in the press conveying mechanism 4 provided with plural pairs of pressing bodies 5 (for example, 5*a*, 5*b*), a mode as set forth below is preferable.

For example, from the viewpoint of excellently keeping the embedding property of the unfixed image T into the thermoplastic resin layer 2*a*, in the press conveying mechanism 4, it is preferable that the nip pressure of the pair of pressing bodies 5*b* positioned at the most downstream side of the image bearing and conveying body 1 is set higher than the nip pressure of the pair of pressing bodies 5*a* at the upstream side.

Besides, in the case where the pressing body 5 has a roll shape, there is a fear that when the recording medium 2 moves along the peripheral surface (roll surface) of the pressing body 5, the recording medium 2 and the image bearing and conveying body 1 slip minutely by the influence of the curvature, which causes deterioration of graininess. Particularly, this tendency is high in the thick recording medium like the recording medium 2 as a subject of the present invention.

From the viewpoint of avoiding such disadvantage (deterioration of graininess due to slip at the curved portion between the recording medium 2 and the image bearing and conveying body 1), in a mode in which at least a part of the pressing bodies 5 is roll-shaped, it is preferable that the press conveying mechanism 4 keeps the region where the recording medium 2 on the image bearing and conveying body 1 is contact-conveyed, linear.

At this time, an entering angle of the recording medium 2 may be suitably determined within such a range that the region where the recording medium 2 on the image bearing and conveying body 1 is contactconveyed becomes linear. Incidentally, even if the image bearing and conveying body 1 itself has a drum shape, if the diameter of the image bearing and conveying body 1 is large and the contact-conveying region can be kept substantially linear, it is possible to solve the foregoing disadvantage to some degree.

Further, from the viewpoint of keeping the temperature drop of the unfixed image T and the thermoplastic resin layer 2*a* of the recording medium 2 between the plural pairs of pressing bodies 5 (5*a*, 5*b*) as small as possible, it is preferable that the plural pairs of pressing bodies 5 are disposed to be close to each other at front and rear positions in the conveying direction of the image bearing and conveying body 1.

In this case, when the respective pressing bodies 5 are formed into the roll shape with the same diameter, it is preferable that the distance between the centers of both is approximately the roll diameter.

On the contrary, in a mode where the distance between the plural pairs of pressing bodies 5 (5*a*, 5*b*) can not be shortened, from the viewpoint of preventing the temperature drop of the image bearing and conveying body 1 positioned between the plural pairs of pressing bodies 5, it is preferable that the press conveying mechanism 4 is constructed such that a heat insulating member (not shown) is provided on the reverse surface of the image bearing and conveying body 1 positioned between the plural pairs of pressing bodies 5 disposed at the front and rear positions in the conveying direction of the image bearing and conveying body 1.

Beside, it is sufficient if the heat supply adjusting mechanism 6 is provided with (1) the heating source 7 for heating the recording medium 2 from both the obverse and reverse sides, and (2) a mechanism for causing heat supplies to the obverse and reverse surfaces of the recording medium 2 to be different from each other.

Here, the heating source 7 is not limited to a mode suitably incorporated in the pressing body 5, but includes various modes such as a mode in which it is provided separately from the pressing body 5 along the image bearing and conveying body 1, or a mode using an electromagnetic induction heating system. The position where the heating source 7 is provided is not limited to a region where the recording medium 2 is contact-conveyed in the image bearing and conveying body 1, but includes one where the image bearing and conveying body 1 is preheated before it comes in contact with the recording medium 2. Incidentally, although it does not matter whether preheating is made on the side of the recording medium 2, if preheating is made to such a degree that the thermoplastic resin layer 2*a* is melted, the thermoplastic resin layer 2*a* adheres to a guide shoot or the like. Thus, preheating is permitted to such a degree that adhesion to the guide shoot or the like does not occur.

Further, as a typical mode of the heat supply adjusting mechanism 6, it is possible to cite a mode where the heating source 7 is provided in the pressing body 5.

As a preferable layout in this case, it is possible to cite such layout of the heat supply adjusting mechanism 6 that among the plural pairs of pressing bodies 5 (5*a*, 5*b*), the heating sources 7 are provided in the pressing bodies 5*a*(1) and 5*b*(1) positioned at the side of the image bearing surface of the recording medium 2 and the most downstream pressing body 5*b*(2) positioned at the side of the non-image bearing surface of the recording medium 2.

Further, from the viewpoint of preventing the temperature rise of the recording medium 2 at the non-image bearing side and preventing the evaporation of moisture in the inside of the recording medium 2 (preventing the blister phenomenon) while the temperature rise of the recording medium 2 at the side of the image bearing surface is accelerated, in the heat supply adjusting mechanism 6, it is preferable to adopt such a mode that the heating source 7 is provided only in the pressing body 5*a*(1) positioned at the side of the image bearing surface of the recording medium 2 between the pressing bodies 5*a* positioned at the most upstream side.

Besides, the present invention also relates to an image forming apparatus provided with, for example, the transfer fixing device 3 shown in FIG. 1.

Figure 2:
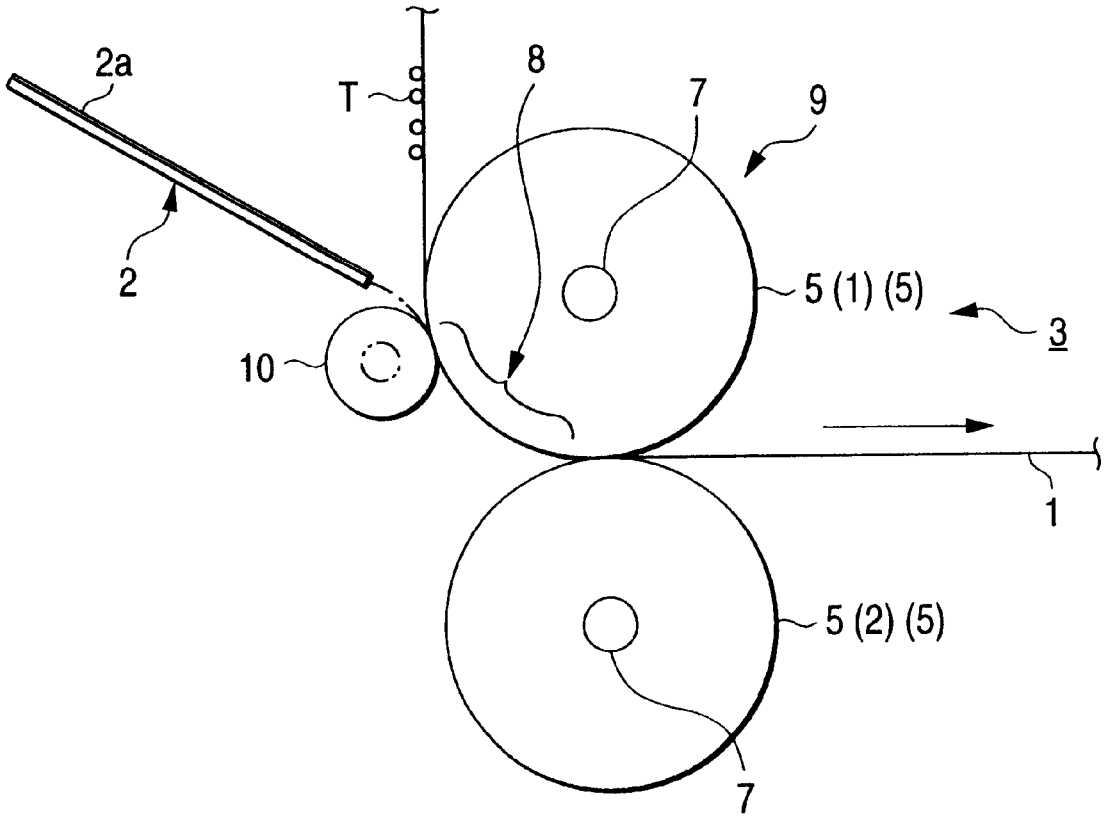
FIG. 2 is an explanatory view showing another mode of a transfer fixing device and an image forming apparatus of the present invention.

In another example, as shown in FIG. 2, in a transfer fixing device 3 in which an image bearing and conveying body 1 for bearing and conveying an unfixed image T is disposed to come in contact with a recording medium 2 provided with a thermoplastic resin layer 2*a* on its surface, and the unfixed image T on the image bearing and conveying body 1 is transferred and fixed in the thermoplastic resin layer 2*a* of the recording medium 2, the transfer fixing device is characterized by including a preheating mechanism 8 for preheating the unfixed image T on the image bearing and conveying body 1 and the thermoplastic resin layer 2*a* of the recording medium 2 mainly from the side of the image bearing and conveying body 1, and a heating and pressing mechanism 9 for heating and pressing the unfixed image T on the image bearing and conveying body 1 and the recording medium 2, which were subjected to the preheating by the preheating mechanism 8, to transfer and fix the unfixed image T on the image bearing and conveying body 1 to the side of the recording medium 2.

In such configuration, FIG. 2 shows a mode in which the structure of the device is simplified. The heating and pressing mechanism 9 is constructed by a pair of pressing bodies 5 which nip and convey the image bearing and conveying body 1 and the recording medium 2 and each of which has a heating source 7. The preheating mechanism 8 includes a facing body 10 disposed in the state where the image bearing and conveying body 1 and the recording medium 2 are nipped between the facing body and one of the pressing bodies 5(1), and at least an image bearing and conveying body region from a passing region between the pressing body 5(1) and the facing body 10 (both may not be necessarily in contact with each other) to a portion before a nip region between the pair of pressing bodies 5 is made a preheating region.

Incidentally, in the present invention, it goes without saying that the heating and pressing mechanism 9 and the preheating mechanism 8 may be separately and independently provided.

Further, in the example of FIG. 2, from the viewpoint of improving the preheating efficiency of the recording medium 2, the heating source 7 may be provided in the facing body 10.

Moreover, from the viewpoint of improving the preheating efficiency to the image bearing and conveying body 1, the preheating mechanism 8 may include also a heating source (not shown) for previously heating the image bearing and conveying body 1 at the upstream side of the region where the recording medium 2 is contactconveyed on the image bearing and conveying body 1.

Besides, the present invention also relates to an image forming apparatus provided with, for example, the transfer fixing device 3 shown in FIG. 2.

Next, the.second aspect of the present invention will be described.

Figure 3:
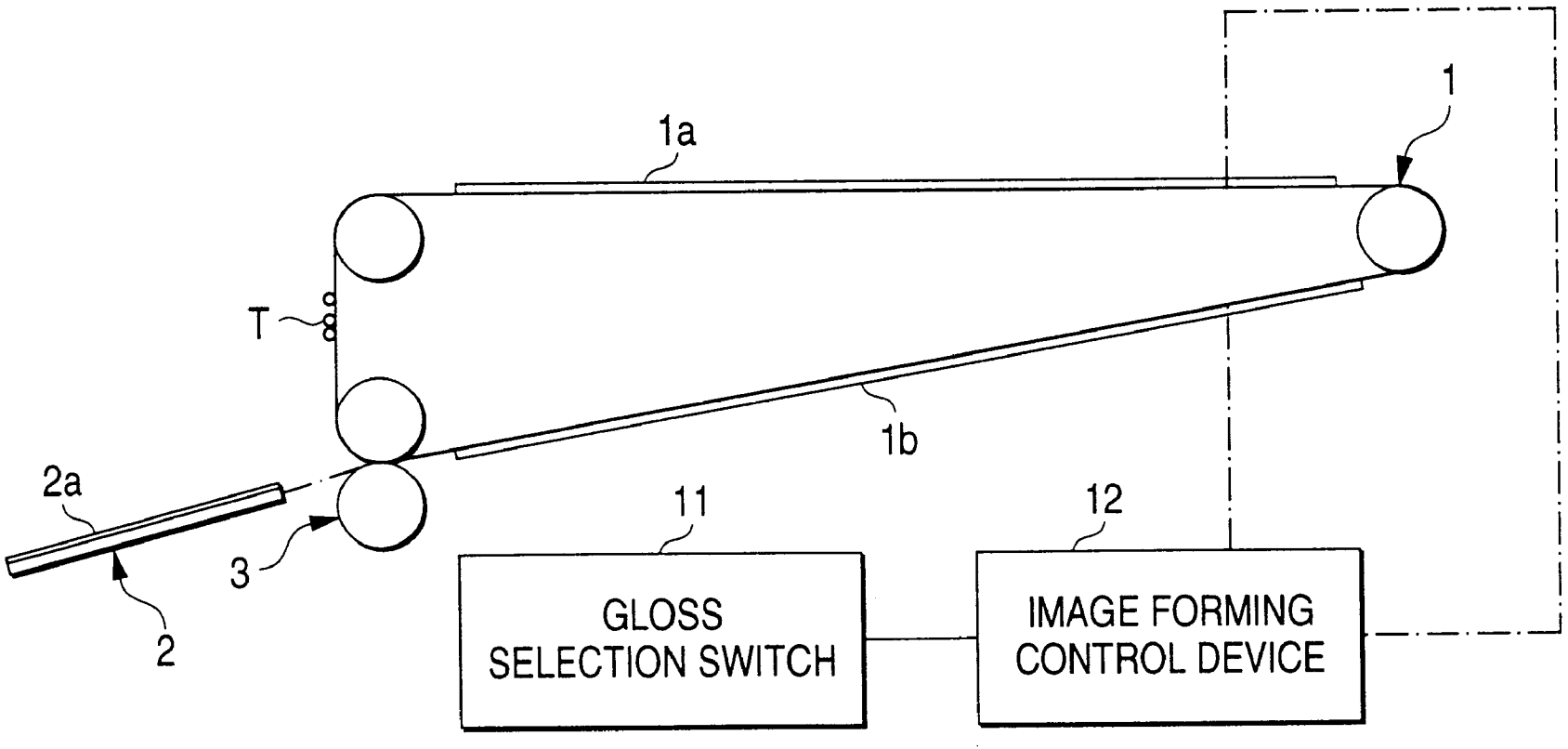
FIG. 3 is an explanatory view showing still another mode of a transfer fixing device and an image forming apparatus of the present invention.

As shown in FIG. 3, in an image bearing and conveying body 1 which bears and conveys an unfixed image T, which is disposed to come in contact with a recording medium 2 provided with a thermoplastic resin layer 2*a* on its surface through the unfixed image T,.and in which the unfixed image T is transferred and fixed in the thermoplastic resin layer 2*a* of the recording medium 2 by a transfer fixing device 3, the image bearing and conveying body is characterized by including plural kinds of, for example, two kinds of gloss surfaces 1*a* and 1*b*.

In such configuration, the structure of the plural kinds of gloss surfaces 1*a* and 1*b* may be suitably.selected such that the surface roughness of the high gloss surface is made small, and the surface roughness of the low gloss surface is made large.

Besides, with respect to a selecting standard of the gloss surfaces 1*a* and 1*b*, various gloss surface regions have only to be set correspondingly to the recording medium 2 of the usable maximum size.

Further, the present invention also relates to an image forming apparatus provided with the image bearing and conveying body 1 like this.

In this case, according to the present invention, as shown in FIG. 3, the image forming apparatus includes the image bearing and conveying body 1 having the different gloss surfaces 1*a* and 1*b*, a gloss selection switch 11 for selecting which gloss surface on the image bearing and conveying body 1 is used, and an image forming control device 12 for causing the gloss surface 1*a* or 1*b* selected by the gloss selection switch 11 to be a usage surface of an image forming cycle.

Embodiment 1

Figure 4:
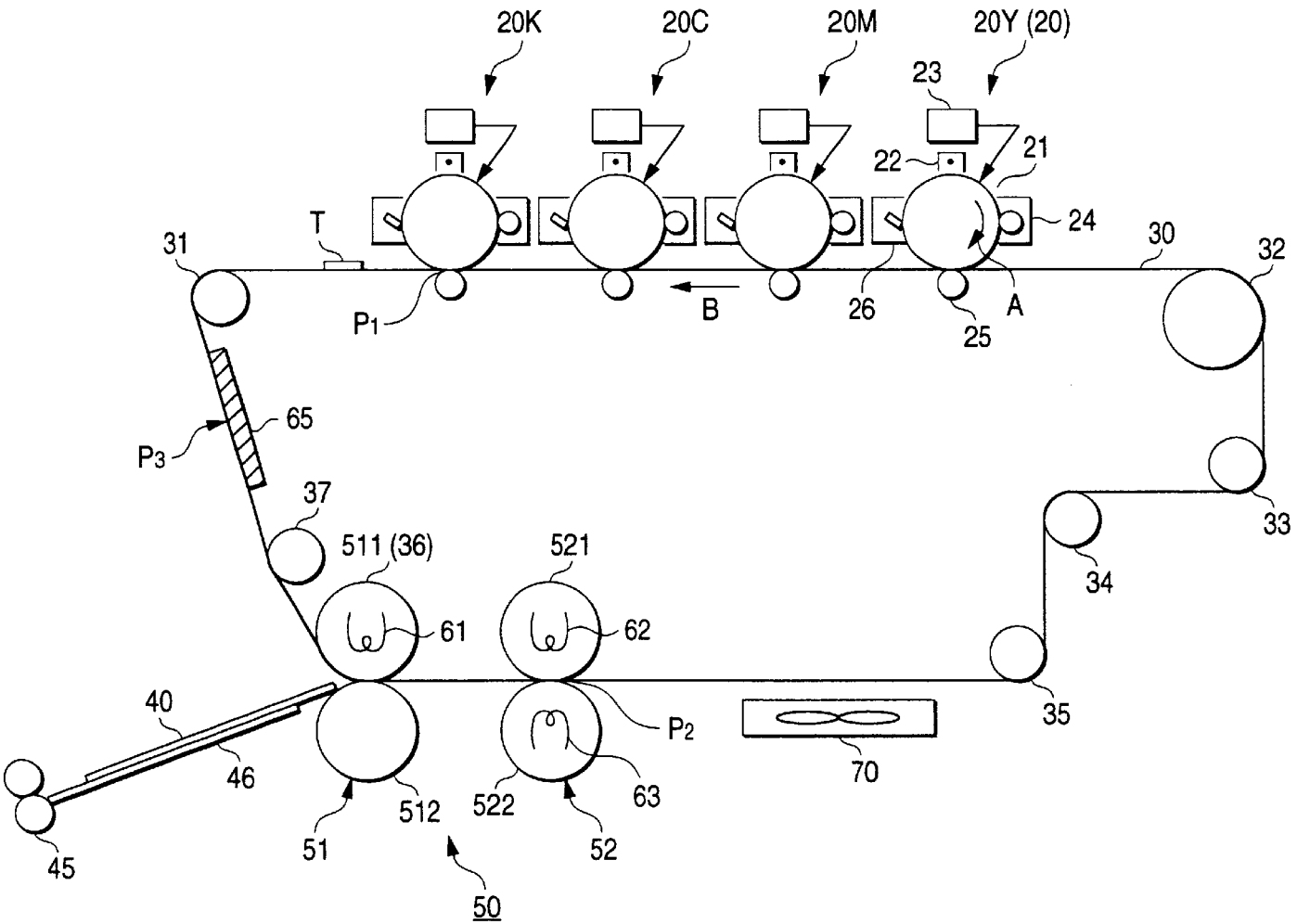
FIG. 4 is an explanatory view showing embodiment 1 of an image forming apparatus to which the present invention is applied.

FIG. 4 is an explanatory view showing an outline of embodiment 1 of an image forming apparatus to which the present invention is applied.

In the drawing, the image forming apparatus is, for example, a tandem type image forming apparatus of an intermediate transfer type, and includes plural image forming units 20 (specifically, 20Y, 20M, 20C, 20K) in which respective color component toner images are formed by, for example, an electrophotographic system, an intermediate transfer belt 30 for sequentially transferring (primary transfer) and holding the respective color component toner images formed by the respective image forming units 20, and a transfer fixing device 50 for transferring and fixing the overlapped images transferred onto the intermediate transfer belt 30 to a recording medium 40.

In this embodiment, as the layout of the respective units 20, for example, the yellow image forming unit 20Y, the magenta image forming unit 20M, the cyan image forming unit 20C, and the black image forming unit 20K are successively disposed from the upstream side in conveying direction B of the intermediate transfer belt 30.

In each of the image forming units 20, around the periphery of a photoreceptor drum 21 rotating in the direction of arrow A, there are sequentially disposed devices for electrophotography, such as a uniform charger 22 for charging the photoreceptor drum 21, a laser exposing apparatus 23 for writing an electrostatic latent image on the photoreceptor drum 21, a developing device 24 containing each color component toner and visualizing the electrostatic latent image on the photoreceptor drum 21, a primary transfer roll 25 as a transfer device for transferring each color component toner image on the photoreceptor drum 21 onto the intermediate transfer belt 30, and a drum cleaner 26 for removing residual toner on the photoreceptor drum 21.

Besides, in this embodiment, as the photoreceptor of the photoreceptor drum 21, in addition to various inorganic photoreceptors such as Se, a-Si, a-SiC, and CdS, various organic photoreceptors may be used.

Besides, as the toner used in the developing device 24, a well-known material made of a thermoplastic binder containing a pigment of yellow, magenta, cyan, or black may be used.

The intermediate transfer belt 30 is extended over plural (in this embodiment, seven) stretching rolls 31 to 37 and is circularly conveyed.

Here, reference numeral 31 designates a drive roll for imparting a driving force to the intermediate transfer belt 30; 32, a tension roll for imparting tension to the intermediate transfer belt 30; 33, 35, driven rolls; 34, a steering roll for adjusting the meandering of the intermediate transfer belt 30; 36, a roll serving also as a pressing roll 511 which is an element of the transfer fixing device 50 described later; and 37, an angle adjusting roll for guiding the intermediate transfer belt 30 to a transfer fixing portion at a constant angle, in the inside of which a heating source (not shown) is provided in this embodiment though it does not particularly matter whether a heating source is made to be provided in the inside.

The intermediate transfer belt 30 is subjected to transfer of the toner image T at a primary transfer position P1 of each of the primary transfer rolls 25, and conveys the transferred toner image T to a transfer fixing position P2.

Here, the transfer of the toner image at the primary transfer position P1 can be performed by a well-known way, for example, by electrostatic force, pressure, or adhesion force.

Besides, the intermediate transfer belt 30 has, for example, a two-layer structure made of a base layer and a surface layer.

As the base layer, a sheet having high heat resistance and having a thickness of 10 $\mu$m to 300 $\mu$m, for example, a polymer sheet of polyester, polyethylene terephthalate, polyethersurfone, polyetherketone, polysulfone, polyimide, polyimidoamide, polyamide, or the like may be used.

As the surface layer, a resin having a thickness of 1 $\mu$m to 100 $\mu$m and having a high peeling property, for example, tetrafluoroethylene—perfluoroalkyl vinyl ether copolymer, polytetrafluoroethylene, silicone rubber, silicon teflon synthetic rubber, or the like may be used.

Figure 5A:
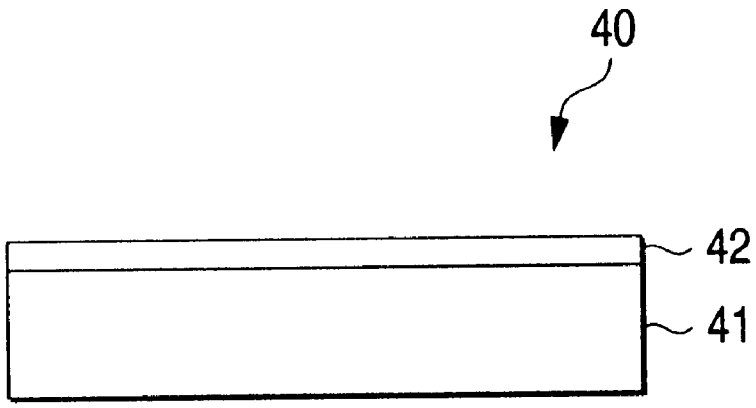
FIGS. 5A and 5B are explanatory views showing structural examples of recording media used in the embodiment.
Figure 5B:
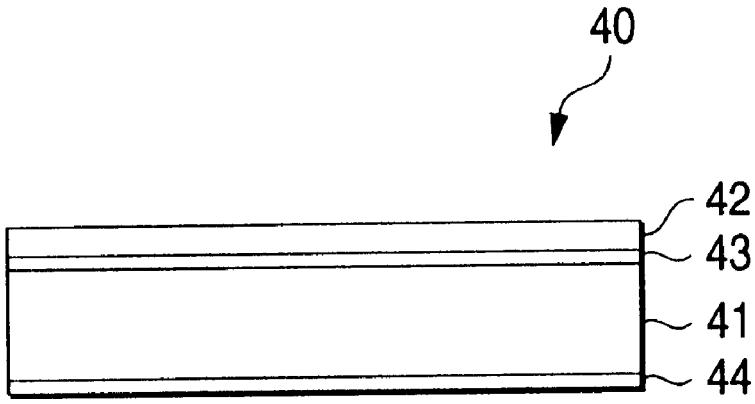

Further, in the recording medium 40 used in this embodiment, as shown in FIG. 5A, a thermoplastic resin layer 42 is coated on the surface of a base member 41, or as shown in FIG. 5B, a thermoplastic resin layer 42 is coated on the surface of a base member 41 through an adhesion layer 43. Besides, as shown in FIG. 5B, there is one in which a back layer 44 for preventing excessive dry of the base member 41 is coated on the reverse surface of the base member 41.

In the recording medium 40 like this, in order to embed, transfer, and fix the toner image T from the intermediate transfer belt 30 in the thermoplastic resin layer 42, there is required heat capacity at least twice as large as that in the case of using a recording medium in which such thermoplastic resin layer 42 is not coated. Thus, in order to obtain an excellent transfer fixing image at high speed, as shown in this embodiment, the transfer fixing device 50 which can supply a large amount of heat becomes necessary.

Here, as the thermoplastic resin layer 42, polyester resin, styrene resin, acryl resin, styrene-acryl resin, or the like is normally used.

Figure 6:
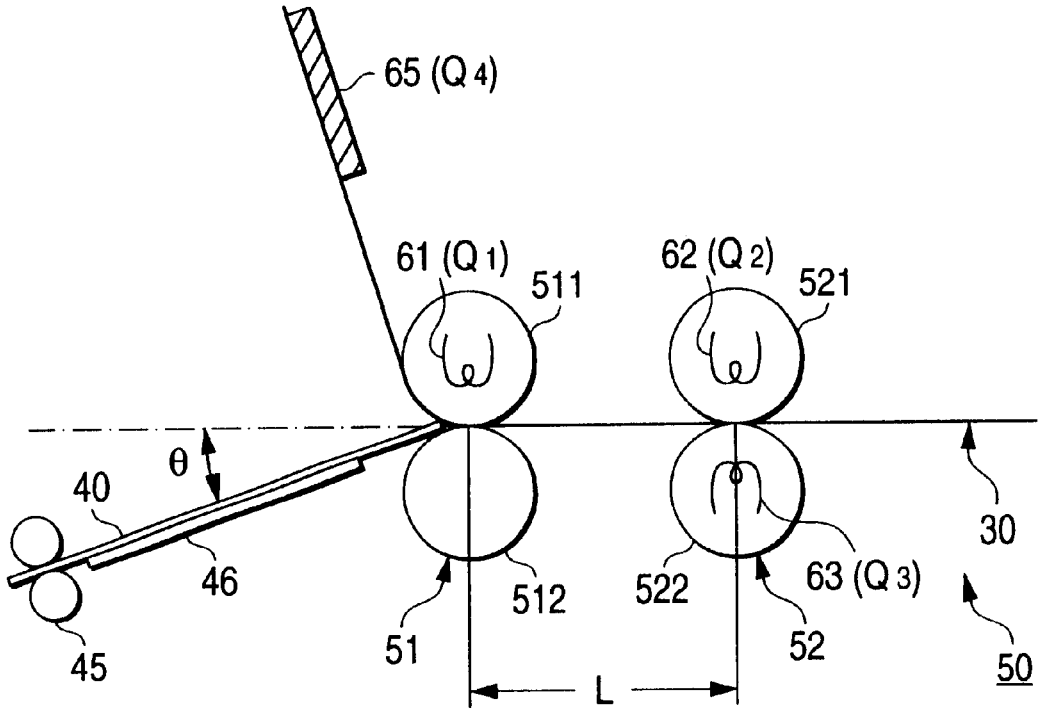
FIG. 6 is an explanatory view showing a structural example of a transfer fixing device of the embodiment.

Besides, in this embodiment, as shown in FIG. 4 and FIG. 6, in the transfer fixing device 50, plural pairs (in this embodiment, two pairs) of pressing rolls 51 (specifically, 511, 512) and 52 (521, 522) are disposed in the conveying direction of the intermediate transfer belt 30, respective nip regions of the pressing rolls 51 and 52 are separated from each other by distance L, and the intermediate transfer belt 30 positioned between the nip regions is disposed to have a horizontal posture.

In FIG. 4, reference numeral 45 designates a feed roll for sending the recording medium 40 to the nip region of the inlet side pressing rolls 51 of the transfer fixing device 50; and 46, a guide shoot for regulating the feed posture of the recording medium 40.

Further, this transfer fixing device 50 includes plural heating sources 61 to 63 and a preheating source 65.

In this embodiment, the heating source 61 is a kortz lamp (halogen lamp) incorporated in the inner roll 511 of the inlet side pressing rolls 51, and the heating sources 62 and 63 are kortz lamps incorporated in the inner roll 521 and the outer roll 522 of the outlet side pressing rolls 52. The preheating source 65 is a heating plate. This heating plate 65 is constructed by, for example, sticking a silicon rubber heater on a curved aluminum plate, and is disposed at a preheating position P3 extending between the primary transfer position P1 and the transfer fixing position P2 of the intermediate transfer belt 30, specifically, at the reverse side of the intermediate transfer belt 30 positioned between the stretching rolls 31 and 37. The heating plate 65 preheats the intermediate transfer belt 30 and the toner image T on the intermediate transfer belt 30 to a predetermined temperature, for example, a temperature over a toner melting temperature. Since preheating of the toner is performed over such a wide region, it becomes possible to circularly moving the intermediate transfer belt 30 at high speed, and the high speed transfer fixing device 50 can be realized.

Here, the toner melting temperature in this embodiment is defined as follows: That is, while a toner of 1.5 g molded by a press molding machine is heated at a temperature rising speed of 3° C./minute from a temperature of 60° C. to 150° C. at an interval of 3° C., a toner flow amount in the case where it is pushed out from a nozzle having a nozzle diameter of 0.5 mm and a nozzle length of 1 mm under a load of 98 N (10 kgf) is measured by using a commercially available flow tester to obtain apparent viscosity η(poise), and a temperature at which the apparent viscosity becomes $10^4$ Pa·s is defined as the toner melting temperature.

Incidentally, although the silicon rubber heater is used as the preheating source 65 used in this embodiment, the invention is not limited to this, but a heater of any structure may be used as long as the intermediate transfer belt 30 and the toner image T on the intermediate transfer belt 30 can be heated to a predetermined temperature, for example, the toner melting temperature or higher. Besides, the preheating source 65 may be constructed by a single heat source or a combination of plural heat sources. The disposed position of the preheating source 65 is not limited to the reverse side of the intermediate transfer belt 30, but may be the obverse side of the intermediate transfer belt 30. Besides, the preheating source 65 may be constructed by incorporating a self heating body in the inside of the intermediate transfer belt 30. In the case of adopting a system where heating is made from the obverse side of the intermediate transfer belt 30, in order to prevent the disturbance of the toner image T by the preheating source 65, a non-contact heating system, for example, a heating system using radiant heat is desirable.

Further, in the case of a color toner image in which the toner image T is made of plural colors, it is desirable to adopt a heating system by far-infrared ray so that irregular heating due to the difference in light absorption characteristics of respective color toners does not occur. A heating time by the preheating source 65 is suitable if the intermediate transfer belt 30 and the toner image T on the intermediate transfer belt 30 are sufficiently heated in the time to a predetermined temperature, for example, the toner melting temperature or higher. However, in the case of the multi-color image where the thickness of the toner image T is different according to the place, in order to prevent irregular melting of the toner, it is necessary to secure a sufficient time so that the temperature distribution of the intermediate transfer belt 30 and the toner image T in the thickness direction becomes uniform. Although the heating tire becomes different according to the material of the toner, the material and thickness of the intermediate transfer belt 30, and the kind of the preheating source 65, it is desirable that the time is specifically 0.3 second or more.

Figure 7A:
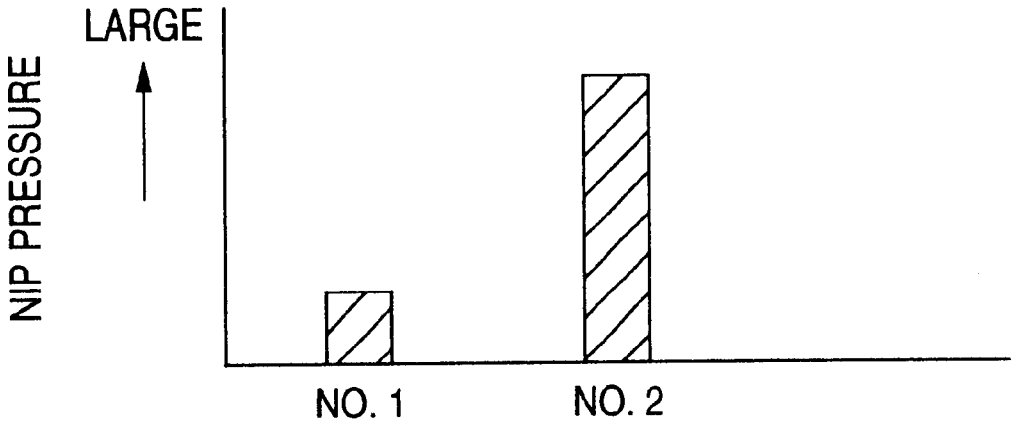
FIG. 7A is a graph showing the relation of nip pressures of respective pairs of pressing rolls of the transfer fixing device of the embodiment.

Besides, in this embodiment, with respect to the nip pressure of the pressing rolls 51 and 52 (No. 1, No. 2) of the transfer fixing device 50, as shown in FIG. 7A, the pressure at the outlet side pressing rolls 52 is set higher than that at the inlet side pressing rolls 51.

Here, with respect to the nip pressure of the inlet side pressing rolls 51, basically, adhesion has only to be secured in the range where the intermediate transfer belt 30 and the recording medium 40 do not slip in an idle state. On the other hand, the nip pressure of the outlet side pressing rolls 52 is required to be a pressure sufficient to completely perform transferring and fixing.

Further, as shown in FIG. 6, since the recording medium 40 enters the nip region of the inlet side pressing rolls 51 from the lower position slanted by an angle θ with respect to the horizontal position, the recording medium 40 and the intermediate transfer belt 30 are not simultaneously conveyed along the curved portions of the pressing rolls 51, and by that, slip does not occur between both.

Thus, as set forth in an example described later, the graininess of a picture image is not damaged.

Further, since the entering passage of the recording medium 40 to the intermediate transfer belt 30 is made lower than the horizontal position, it is possible to reduce the quantity of the bubble nipped between the intermediate transfer belt 30 and the recording medium 40 at the time of contact of them, and by that, the adhesion of both can be raised.

Besides, with respect to the kortz lamp 61 as the heating source in the inner roll 511 of the inlet side pressing rolls 51, temperature is set so that the temperature of the surface of the inner roll 511 becomes equal to or higher than, for example, the counter roll 37 or the heating plate 65 positioned at the upstream side. The inlet side pressing rolls 51 cause the thermoplastic resin layer 42 of the surface of the recording medium 40 to be in contact with the toner image T and the intermediate transfer belt 30 (in the state where it is heated by the inner roll 511), and a time in which heat is sufficiently conducted to the thermoplastic resin layer 42 of the recording medium 40 is secured by the distance L to the outlet side pressing rolls 52.

By this, the viscosity of the thermoplastic resin layer 42 is lowered, and embedding of the toner image T into the thermoplastic resin layer 42 is certainly performed at the transfer fixing position P2 of the outlet side pressing rolls 52.

At this time, since the outer roll 512 of the inlet side pressing rolls 51 is not heated, a temperature rise of the reverse surface (non-image bearing surface) of the recording medium 40 is small, and evaporation of moisture in the inside of the base member 41 does not occur.

Further, the outlet side pressing rolls 52 nip the intermediate transfer belt 30 and the recording medium 40 at the outlet position of the transfer fixing position P2.

Here, as the outlet side pressing rolls 52 (521, 522), for example, a roll in which a core metal made of aluminum is covered with thermosetting silicone rubber is used. Any material may be used for the material of the outlet side pressing rolls 52 as long as it can withstand pressure and heating at the transfer fixing step.

Besides, in this embodiment, although the outlet side pressing rolls 52 are used, the invention is not limited to this, but any structure may be used as long as it can uniformly press the intermediate transfer belt 30 and the recording medium 40 without generation of floating or slip between the intermediate transfer belt 30 and the recording medium 40. For example, it may be constructed by a combination of one pressing roll and one fixed pad, or a pair of fixed pads.

It is needless to say that the design of the inlet side pressing rolls 51 can also be changed like the outlet side pressing rolls 52.

Besides, in this embodiment, the kortz lamp 62 as the heating source is provided in the inside of the inner roll 521 of the outlet side pressing rolls 52, and heats the inner roll 521 to a temperature, for example, the melting temperature of toner or higher. On the other hand, the kortz lamp 63 as the heating source is provided in the inside of the outer roll 522 of the outlet side pressing rolls 52, and heats the outer roll 522 to, for example, a temperature lower than the melting temperature of toner.

Thus, at the outlet portion of the transfer fixing position P2, the surface of the intermediate transfer belt 30 at the side where the toner image T is not transferred is heated and pressed by the inner roll 521 heated up to the temperature higher than the melting temperature of toner, and the surface of the intermediate transfer belt 30 at the side where the toner image T is transferred is heated and pressed by the outer roll 522 heated up to the temperature lower than the melting temperature of toner.

Thus, in the outlet side pressing rolls 52, since the inside of the intermediate transfer belt 30 is heated and the reverse side (non-image bearing surface side) of the recording medium 40 is not heated, while the temperature rise of the surface of the recording medium 40 is accelerated, the temperature rise of the reverse surface is prevented.

Like this, it is the key to the transfer fixing at high speed that the viscosity of the thermoplastic resin layer 42 of the recording medium 40 and the toner can be raised somehow. In this embodiment, the manner of securing a time is adopted, and it becomes possible to make transfer fixing in the state where the toner image T is completely embedded in the thermoplastic resin layer 42 of the recording medium 40. By that, the smoothness of the toner image T is excellently kept and an excellent gloss is naturally obtained, and there is also an effect not to cause the blister phenomenon by the temperature rise of only the necessary surface of the recording medium 40.

Especially, in this embodiment, by the existence of the inlet side pressing rolls 51, it is possible to lower the pressure and temperature at the outlet side pressing rolls 52 which actually perform embedding of the toner image, and also in this point, the occurrence of the blister phenomenon can be prevented, and collapse or extension of toner can be effectively prevented.

Like this, with respect to the pressure condition (nip pressure of the pressing rolls 51 and 52) of the transfer fixing device 50 and the temperature condition (supply heat quantity Q1 to Q4 of the respective heating sources 61 to 63 and the preheating source 65), they may be suitably selected from the viewpoint of the embedding property of the toner image T in the thermoplastic resin layer 42 of the recording medium 40 and the avoidance of defects in picture quality resulting from the blister phenomenon or the like. However, with respect to the heat supply quantity at least in a period when the recording medium 40 is contact-conveyed with the intermediate transfer belt 30, it is necessary to make the quantity at the side of the thermoplastic resin layer 42 of the recording medium 40 large.

Further, in this embodiment, a cooling device 70 for cooling the surface side of the intermediate transfer belt 30 is disposed at the downstream side where the intermediate transfer belt 30 has passed through the transfer fixing device 50.

As the cooling apparatus 70, various structures may be suitably selected, for example, a cooling fan is provided, or a ventilation duct communicating with a ventilation fan provided in the image forming apparatus is provided and ventilation air from the ventilation duct is used.

In this embodiment, by adjusting the air amount of the cooling apparatus 70, when the recording medium 40 is peeled off from the intermediate transfer belt 30 at the stretching roll 35 (functioning as a peeling roll), the surface temperature of the recording medium 40 being in contact with the intermediate transfer belt 30 is adjusted to become a predetermined temperature (for example, it may be a temperature not higher than solidification or softening temperature of toner) at which the fixed toner image is not broken at the time of peeling, for example, 70° C.

Next, the basic operation of the image forming apparatus of this embodiment will be described.

In FIG. 4, in the respective image forming units 20, the respective color component toner images T are sequentially transferred onto the intermediate transfer belt 30 at the primary transfer positions P1.

Thereafter, the toner image T of plural colors on the intermediate transfer belt 30 is heated up to, for example, the melting temperature of toner by the heating plate 65 through the intermediate transfer belt 30 and is melted, and reaches the transfer fixing device 50. On the other hand, the recording medium 40 supplied from a not-shown recording medium supply tray also reaches the nip region of the inlet side pressing rolls 51 of the transfer fixing device 50, and the toner image T is brought into close contact with the recording medium 40 in the nip region of the inlet side pressing rolls 51.

At this time, by the intermediate transfer belt 30 heated by the heating plate 65 and the melted toner image T, heat is conducted to the thermoplastic resin layer 42 (see FIG. 5) of the surface of the recording medium 40, so that the thermoplastic resin layer 42 is softened/melted.

Further, by heat conduction from the inner roll 511 of the inlet side pressing rolls 51, the base member 41 portion of the recording medium 40 is also heated, so that the temperature of the thermoplastic resin layer 42 is raised.

In this way, the toner image T in the melted state and the thermoplastic resin layer 42 are moved, in the close contact state, to the outlet side pressing rolls 52.

By this, the toner image T and the thermoplastic resin layer 42 of the surface of the recording medium 40 heated up to, for example, the melting temperature or higher are sufficiently softened/melted, and are further heated and pressed by the outlet side pressing rolls 52, so that the toner image T sufficiently sinks in the thermoplastic resin layer 42 coated on the recording medium 40, and a surface smooth plane is formed.

In this embodiment, although the toner image T and the thermoplastic resin layer 42 are softened/melted before reaching the outlet side pressing rolls 52, the invention is not limited to this, but it is needless to say that the embodiment may be modified such that the toner image T and the thermoplastic resin layer 42 are merely in the softened state before reaching the outlet side pressing rolls 52, and a sufficient transfer fixing property is obtained by the portion of the outlet side pressing rolls 52.

Thereafter, the recording medium 40 is moved while it is in close contact with the intermediate transfer belt 30, and is cooled by the cooling apparatus 70.

By this, the toner permeated in the thermoplastic resin layer 42 of the recording medium 40 coheres and is solidified, and strong adhesion force to the recording medium 40 is generated.

Thereafter, at the stretching roll 35 of a small curvature, the recording medium 40, together with the toner image T, is separated from the intermediate transfer belt 30 by the nerve of the recording medium 40 itself, and a color picture image is formed.

In this state, the toner image T transferred/fixed to the recording medium 40 is united with the thermoplastic resin layer 42 of the surface of the recording medium 40, and the surface is smoothed and has a high gloss.

Besides, the toner image T is sufficiently embedded in the thermoplastic resin layer by sufficient heat conduction, the gloss of the surface becomes high, and there occurs neither deterioration of graininess nor generation of bubbles.

This is confirmed in an embodiment described later.

Besides, in this embodiment, as the transfer fixing device 50, although the mode of using the two pairs of pressing rolls 51 and 52 has been described, the design may be suitably changed as described below.

Figure 8A:
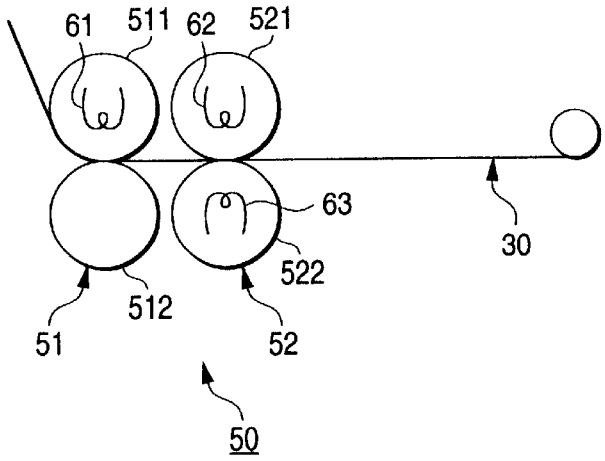
FIGS. 8A to 8C are explanatory views showing structural examples of modified transfer fixing devices.

For example, FIG. 8A shows an example in which two pairs of pressing rolls 51 and 52 are disposed, and as compared with the mode (see FIG. 6) shown in the embodiment 1, the pitch (equivalent to a distance between center shafts) between the pressing rolls 51 and 52 is made as narrow as possible, and is set to approximately a roll diameter.

Actually, an error in the roll diameter is taken into consideration, the pitch is set slightly ($\alpha$) larger than the roll diameter, and it is sufficient if both the pressing rolls 51 and 52 are made to be closely disposed.

By this, it becomes possible to prevent the lowering of temperature of the toner and the thermoplastic resin layer 42 of the recording medium 40 to the utmost in a time when they moves from the inlet side pressing rolls 51 to the outlet side pressing rolls (equivalent to embedding rolls directly contributing to embedding of a toner image).

Figure 8B:
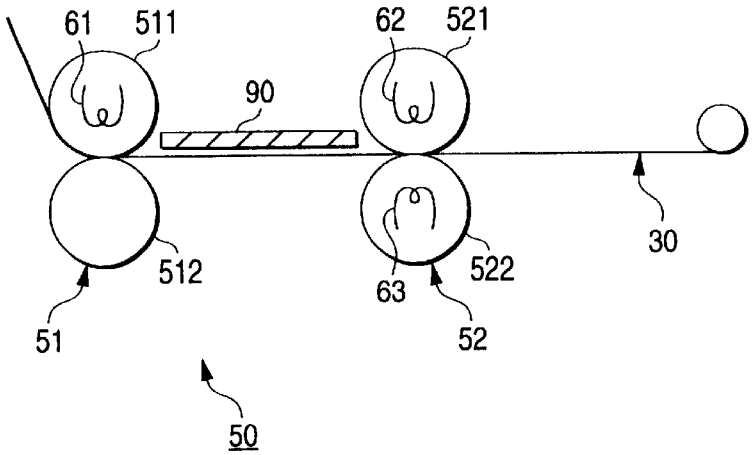

FIG. 8B shows a mode which is effective in the case where two pairs of pressing rolls 51 and 52 can not be made approached each other by, for example, the influence of layout, and a heat insulating guide 90 is disposed at the reverse side of the intermediate transfer belt 30 positioned between both the pressing rolls 51 and 52.

This heat insulating guide 90 is a plate made of plastic or sheet metal, which is disposed at a position distant from the reverse surface position of the intermediate transfer belt 30 by, for example, 5 mm in order to suppress the flow of air above the intermediate transfer belt 30, and suppresses a cooling phenomenon in the inside space of the intermediate transfer belt 30.

Figure 8C:
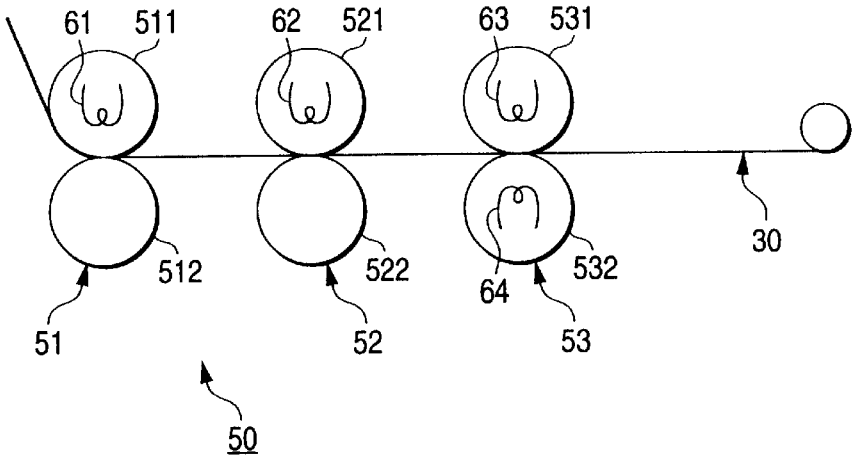

Further, FIG. 8C shows a mode meeting transfer fixing at higher speed, and three pairs of pressing rolls 51, 52 and 53 are disposed front and rear in the conveying direction of the intermediate transfer belt 30. The respective nip regions are disposed linearly, and kortz lamps 61 to 64 as heating sources are provided in the inner rolls of the respective pressing rolls 51 to 53 and the outer roll 532 of the outlet side pressing rolls 53 positioned at the most downstream side.

At this time, the inlet side pressing rolls 51 and the center pressing rolls 52 mainly soften/melt or soften the thermoplastic resin layer (not shown) of the recording medium and the toner image (not shown) on the intermediate transfer belt 30, and the toner image is embedded in the thermoplastic resin layer of the recording medium by the outlet side pressing rolls 53.

Figure 7B:
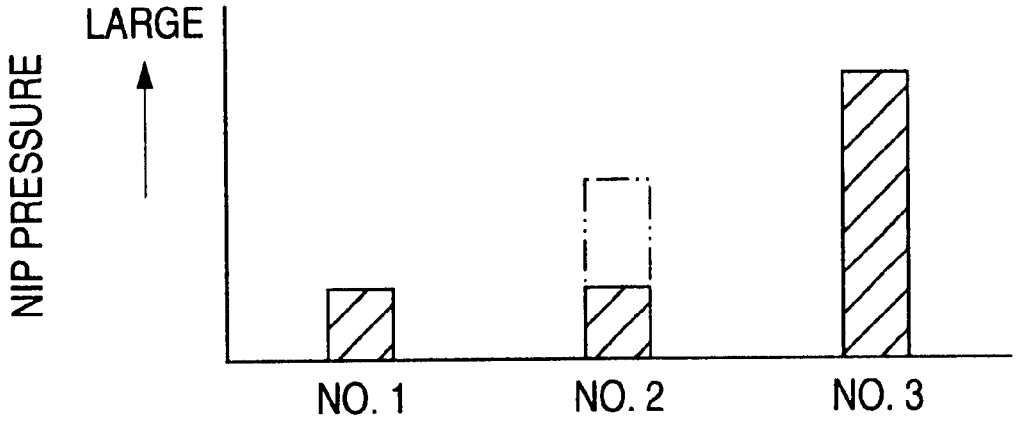
FIG. 7B is a graph showing the relation of nip pressures of respective pairs of pressing rolls of a transfer fixing device of a modification.

In this embodiment, as shown in FIG. 7B, with respect to the nip pressures of the respective pressing rolls 51 to 53 (No. 1 to No. 3), the nip pressure of the outlet side pressing rolls 53 at the most downstream side is highest, and the nip pressures of the other pressing rolls 51 and 52 are set low. Incidentally, as shown by an imaginary line in FIG. 7B, as needed, the nip pressure of the center pressing rolls 52 may be adjusted so that it becomes higher than the nip pressure of the inlet side pressing rolls 51 and lower than the nip pressure of the outlet pressing rolls 53.

Besides, in this embodiment, although the tandem type image forming apparatus is shown as the image forming apparatus, the invention is not limited to this, but a single engine system or a system in which an intermediate transfer belt is not used but a belt photoreceptor having heat resistance is used so that toner images of plural colors formed on the belt photoreceptor are directly transferred and fixed onto a recording medium, may be used. This point is the same with the following embodiment.

Embodiment 2

Figure 9:
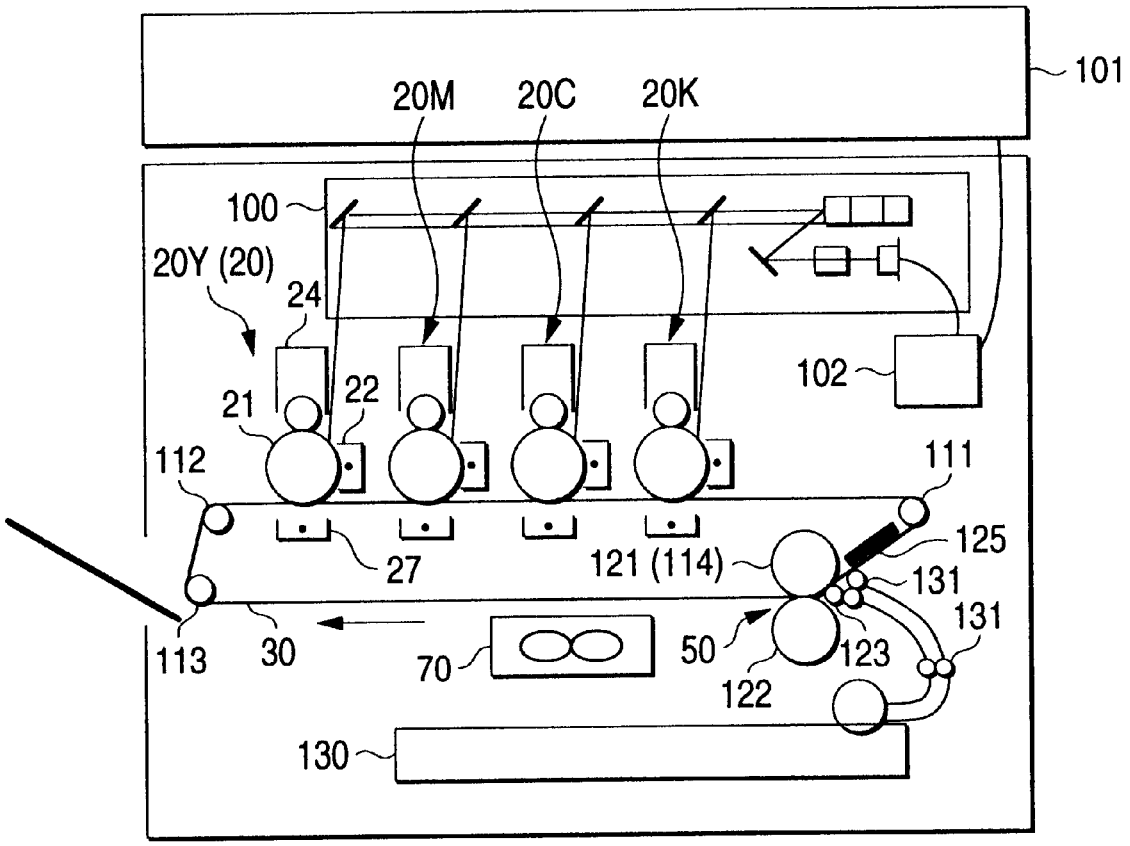
FIG. 9 is an explanatory view showing embodiment 2 of an image forming apparatus to which the present invention is applied.

FIG. 9 is an explanatory view showing the outline of embodiment 2 of an image forming apparatus to which the present invention is applied. Incidentally, the same structural elements as the embodiment 1 are designated by the same reference numerals and their explanation is omitted here.

In the drawing, the image forming apparatus is a tandem type image forming apparatus of an intermediate transfer type similar to the embodiment 1, and includes plural image forming units 20 (specifically, 20Y, 20M, 20C, 20K) in which respective color component toner images are formed by, for example, an electrophotographic system, an intermediate transfer belt 30 for sequentially transferring (primary transfer) and holding the respective color component toner images formed by the respective image forming units 20, and a transfer fixing device 50 for transferring and fixing the overlapped images transferred onto the intermediate transfer belt 30 to a recording medium 40 (see FIG. 5).

In this embodiment, in each of the image forming units 20, around the periphery of a photoreceptor drum 21, there are disposed devices for electrophotography, such as a uniform charger 22 like a corotron, a developing device 24, and a charger 27 like a corotron for transferring the toner image formed on the photoreceptor drum 21 onto the intermediate transfer belt 30.

In this embodiment, a laser exposing device 100 is made of one unit common to the respective image forming units 20 (20Y to 20K), and is constructed such that four color image recording signals of YMCK transferred from, for example, an image processing device 101 are pulse-width modulated by, for example, a screen generator 102, and on the basis of this, electrostatic latent images of yellow, magenta, cyan, and black are written in the photoreceptor drums 21 of the respective image forming units 20.

Besides, in this embodiment, the intermediate transfer belt 30 is extended on plural (in this embodiment, four) stretching rolls 111 to 114 and is circularly conveyed.

Here, reference numeral 111 designates a drive roll for imparting a driving force to the intermediate transfer belt 30; 112, a driven roll; 113, a tension roll; and 114, a roll serving also as a heating roll 121 of an element of a transfer fixing device 50 described later.

Further, reference numeral 130 designates a recording medium supply tray for accommodating the recording medium 40 (see FIG. 5); and 131, a recording medium conveying mechanism for guiding the recording medium 40 sent from the recording medium supply tray 130 to a transfer fixing region of the transfer fixing device 50.

Figure 10:
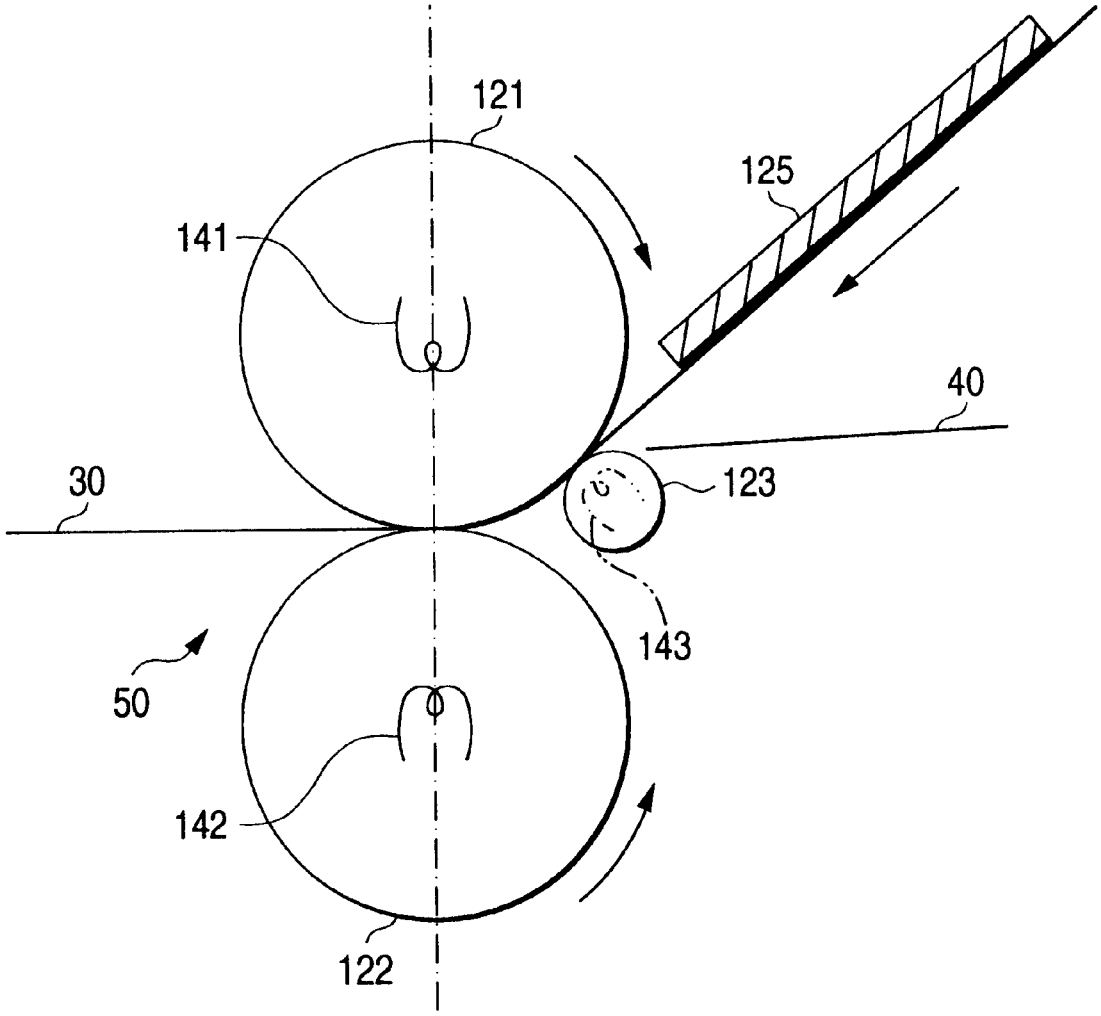
FIG. 10 is an explanatory view showing a structure of a transfer fixing device of the embodiment.

Particularly, in this embodiment, differently from the embodiment 1, as shown in FIG. 10, the transfer fixing device 50 includes the heating roll 121 (serving also as the stretching roll 114) having a built-in heating source 141, a pressure roll 122 disposed to be in press contact with the heating roll 121 through the intermediate transfer belt 30 and having a built-in heating source 142, and a facing roll 123 disposed to face the heating roll 121 at a portion of the intermediate transfer belt 30 apart from the nip region of the heating roll 121 and the pressure roll 122 toward the upstream side.

Here, as the heating roll 121 and the pressure roll 122, a metal roll or a metal roll having a heat resistant elastic layer such as silicone rubber can be used. The heating sources 141 and 142, for example, kortz lamps are disposed in the inside of the heating roll 121 and the pressure roll 122, and the heating temperature is set and controlled so that the toner and the thermoplastic resin layer 42 (see FIG. 5) on the recording medium 40 come to have, for example, their respective melting temperatures or higher.

Besides, as the facing roll 123, although a metal roll, for example, is used, a metal roll having a heat resistant layer such as silicone rubber may be used like the heating roll 121 or the like. Although the facing roll 123 may be disposed to be in contact with the heating roll 121, it may be disposed to be in non-contact with the heating roll 121 if it can guide the recording medium 40 so that the recording medium is brought into contact with the side of the heating roll 121. Further, a heating source 143 (for example, kortz lamp) is incorporated in the facing roll, as needed.

Besides, in this embodiment, the transfer fixing device 50 includes a heating plate 125 as an auxiliary heating source disposed at the upstream side of the nip region of the heating roll 121 and the facing roll 123 and at the reverse side of the intermediate transfer belt 30.

Here, as the heating plate 125, for example, an aluminum plate to which a silicone rubber heater is stuck is used.

The heating temperature is set and controlled to a temperature sufficiently higher than the melting temperature of toner so that the toner on the intermediate transfer belt 30 is sufficiently softened or softened/melted, and heat quantity sufficient to soften/melt the thermoplastic resin layer 42 on the recording medium can be given when it is brought into close contact with the recording medium 40.

Further, in this embodiment, reference numeral 70 designates a cooling device for cooling the recording medium 40 and the intermediate transfer belt 30 which have passed through the transfer fixing device 50. In this embodiment, the air amount of the cooling apparatus 70 is adjusted so that the temperature of the surface of the recording medium 40 being in contact with the intermediate transfer belt 30 becomes, for example, 100° C. or less when the recording medium 40 is peeled off from the intermediate transfer belt 30.

Next, the operation of the image forming apparatus of this embodiment will be described.

In FIGS. 9 and 10, the respective image forming units 20 (20Y to 20K) sequentially primary-transfer the respective color component toner images onto the intermediate transfer belt 30.

Thereafter, the toner image of plural colors on the intermediate transfer belt 30 is heated up to a predetermined temperature, for example, the melting temperature of toner or higher by the heating plate 125 through the intermediate transfer belt 30, is softened/melted, and passes through the nip region between the facing roll 123 and the heating roll 121.

On the other hand, the recording medium 40 is inserted into the nip region between the facing roll 123 and the heating roll 121 from the recording medium supply tray 130 by the recording medium conveying mechanism 131.

At this time, heat is conducted to the thermoplastic resin layer 42 (see FIG. 5) of the recording medium 40 by the high temperature intermediate transfer belt 30 and the softened/melted toner image, so that the thermoplastic resin layer 42 of the recording medium 40 is softened/melted, the intermediate transfer belt 30 and the recording medium 40 are moved to a portion where they are nipped by the heating roll 121 and the pressure roll 122 while they are in a close contact state through the softened/melted thermoplastic resin layer 42, and they are heated and pressed at the portion where they are nipped between the heating roll 121 and the pressure roll 122. By this, the toner heated up to, for example, the melting temperature or higher and the thermoplastic resin layer 42 of the surface of the recording medium 40 are sufficiently softened/melted, and the toner is permeated in the thermoplastic resin layer 42 coated on the recording medium 40, in other words, sinks in the layer.

Figure 12A:
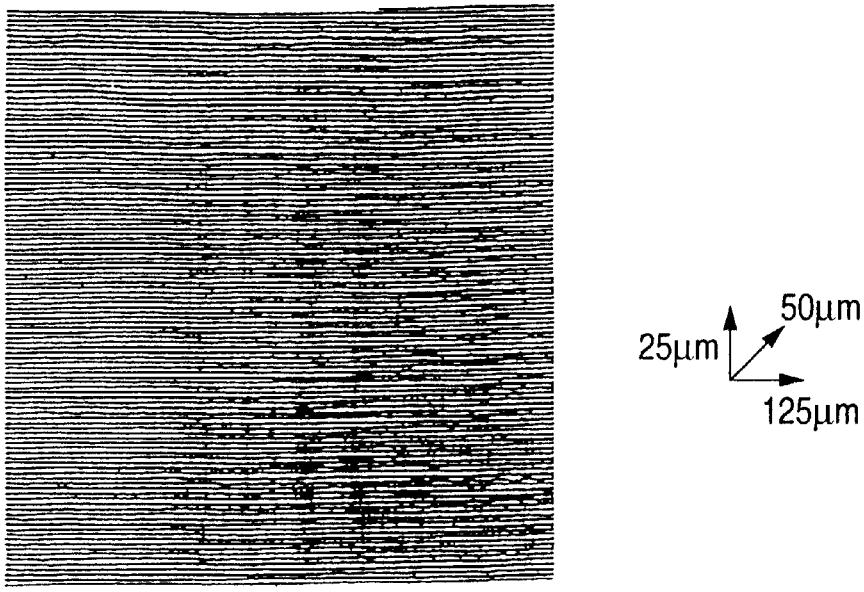
FIG. 12A is an explanatory view showing a state of a transferred and fixed image of the image forming apparatus of the embodiment.

As a result, the unevenness of the surface of the recording medium 40 in the halftone region disappears, and for example, as shown in FIG. 12A, a stepped portion feeling disappears and a high gloss picture image can be obtained.

Figure 12B:
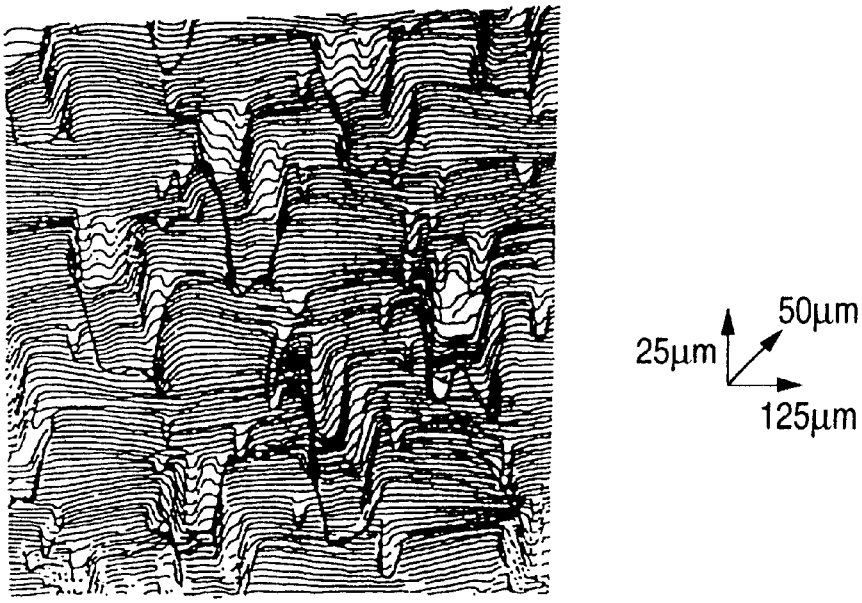
FIG. 12B is an explanatory view showing a state of a transferred and fixed image of a comparative image forming apparatus.

Incidentally, in a comparative example in which the facing roll 123 is not used, but the recording medium 40 is directly guided to the nip region between the heating roll 121 and the pressure roll 122, as shown in FIG. 12B, the unevenness of the surface of the recording medium 40 in the halftone region remains as it is, a stepped portion feeling directly appears, and irregular gloss is also generated.

Thereafter, the intermediate transfer belt 30 and the recording medium 40 are moved while they are in close contact with each other, and are cooled by the cooling apparatus 70. By this, the toner permeated in the thermoplastic resin layer 42 coheres and is solidified, and a strong adhesion force to the recording medium 40 is generated. Thereafter, at the stretching roll 113 with a small curvature, the recording medium 40, together with the toner, is separated from the intermediate transfer belt 30 by the nerve of the recording medium itself, and a color picture image is formed.

In this state, the toner image transferred and fixed to the recording medium 40 is united with the thermoplastic resin layer 42 of the surface of the recording medium 40, and the surface is smoothed and becomes highly glossy.

Figure 11:
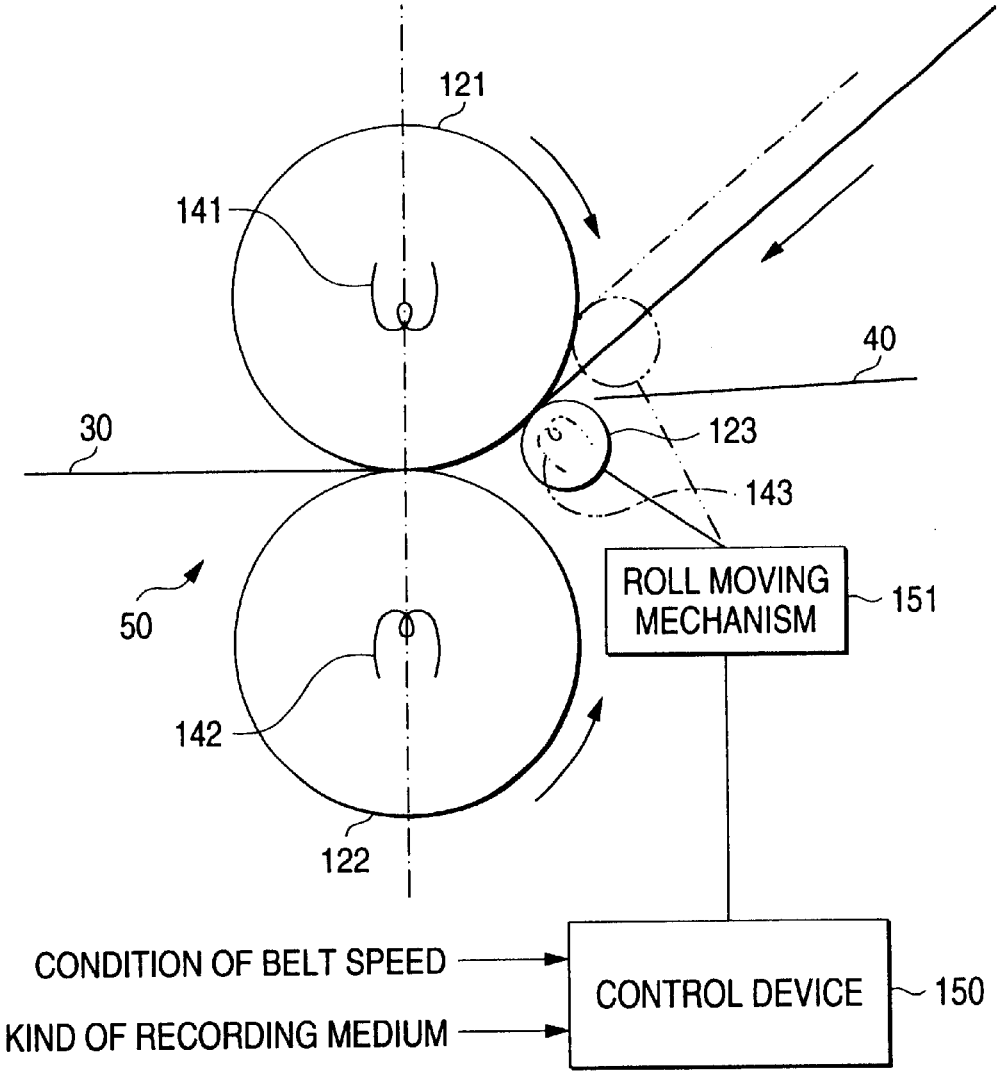
FIG. 11 is an explanatory view showing a modification of the transfer fixing device of the embodiment.

Besides, in this embodiment, although the position of the facing roll 123 is fixed, the invention is not limited to this. For example, as shown in FIG. 11, a roll moving mechanism 151 for enabling the facing roll 123 to move in an outer peripheral direction of the heating roll 121 is added, and a control apparatus 150 sends a drive control signal to the roll moving mechanism 151 in accordance with the kind of the recording medium 40 and the conveying speed (belt speed condition) of the intermediate transfer belt 30 to change the position of the facing roll 123, so that it is possible to realize the apparatus which can meet the change of thickness of the recording medium 40, or the recording medium 40 having different thickness or heat melting characteristic of the thermoplastic resin layer 42 coated on the recording medium 40. In the case where the conveying speed of the intermediate transfer belt 30 is high, such constitution may be adopted that the position of the facing roll 123 is moved in the leaving direction from the position where heating and pressing is made by the heating roll 121 and the pressure roll 122, so that a time of close contact between the intermediate transfer belt 30 and the recording medium 40 can be made constant.

Besides, in this embodiment, although a metal roll is used as the facing roll 123, a heat resistant layer such as silicone rubber is provided on the surface of the facing roll 123, and a nip position relation between the facing roll 123 and the heating roll 121 is adjusted, so that the nip region between the facing roll 123 and the heating roll 121 is changed, and a time of close contact of the recording medium 40 to the facing roll 123 can be lengthened. Thus, even if the conveying speed of the intermediate transfer belt 30 is changed, the toner and the thermoplastic resin layer 42 of the recording medium 40 can be heated up to the melting temperature or higher without changing the position of the facing roll 123 in the outer peripheral direction of the heating roll 121.

Further, in this embodiment, although heat radiation from the reverse side of the recording medium 40 occurs while the intermediate transfer belt 30 is in close contact with the recording medium 40, a heat insulating member may be disposed at the reverse side of the recording medium 40 in order to suppress the heat radiation.

Further, when the recording medium 40 with large weighing is used, according to the position of the facing roll 123, there is a possibility that the intermediate transfer belt 30 does not come in close contact with the recording medium 40 by the nerve of the recording medium 40. In such a case, the diameter of the heating roll 121 is made large to decrease its curvature, or a guide member may be provide to come in close contact with the reverse surface of the recording medium 40.

Embodiment 3

Figure 13:
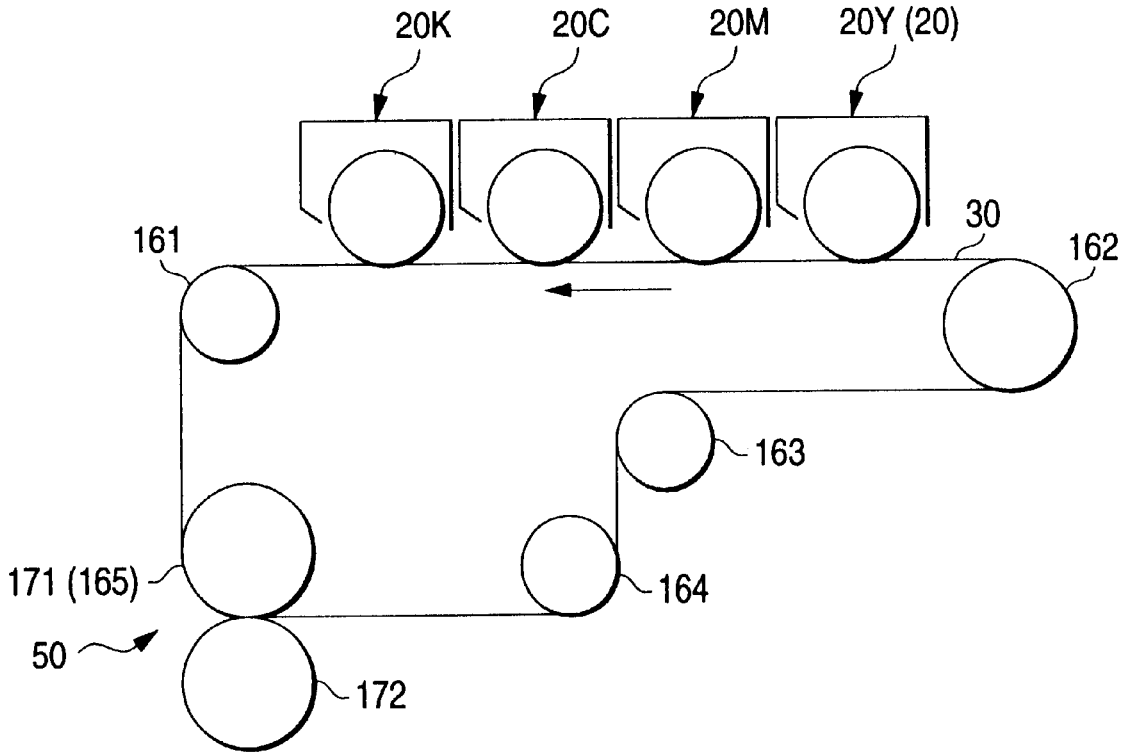
FIG. 13 is an explanatory view showing embodiment 3 of an image forming apparatus to which the present invention is applied.

FIG. 13 shows embodiment 3 of an image forming apparatus to which the present invention is applied.

In the drawing, substantially similarly to the embodiment 1, the image forming apparatus includes plural image forming units 20 (specifically, 20Y, 20M, 20C, 20K) in which respective color component toner images are formed by, for example, an electrophotographic system, an intermediate transfer belt 30 for sequentially transferring (primary transfer) and holding the respective color component toner images formed by the respective image forming units 20, and a transfer fixing device 50 for transferring and fixing the overlapped images transferred onto the intermediate transfer belt 30 to a recording medium 40 (not shown).

In this embodiment, the intermediate transfer belt 30 is extended on plural (in this embodiment, five) stretching rolls 161 to 165 and is circularly moved.

Here, reference numeral 161 designates a drive roll for driving the intermediate transfer belt 30; 162, 164, driven rolls; 163, a tension roll for imparting tension to the intermediate transfer belt 30; and 165, a roll serving also as a heating roll 171 of an element of a transfer fixing device 50.

Besides, in this embodiment, the transfer fixing device 50 includes a heating roll 171 having a built-in heating source and a pressure roll 172 disposed to face the heating roll 171 through the intermediate transfer belt 30 and having a built-in heating source.

Figure 14:
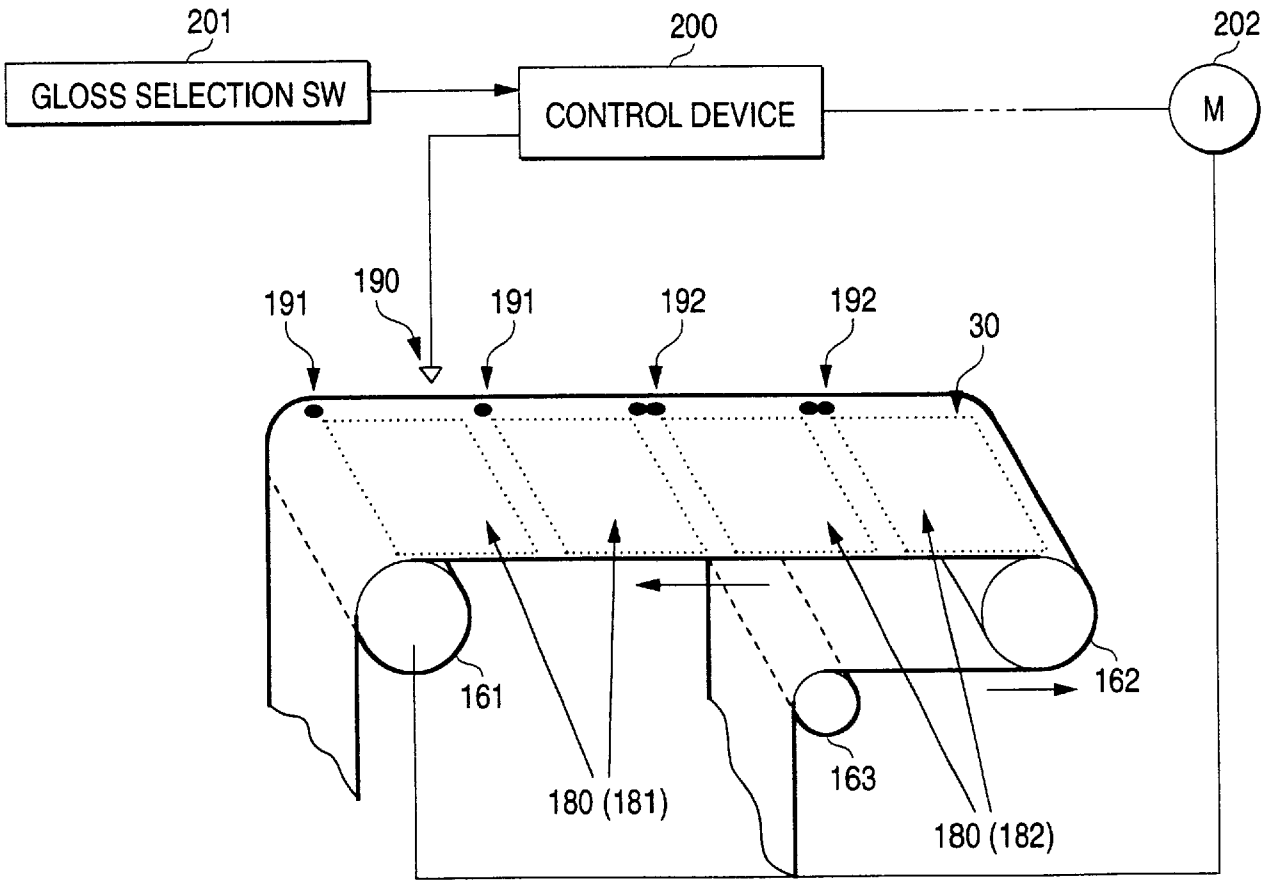
FIG. 14 is a block diagram showing an image forming control system in the embodiment.
Figure 15A:
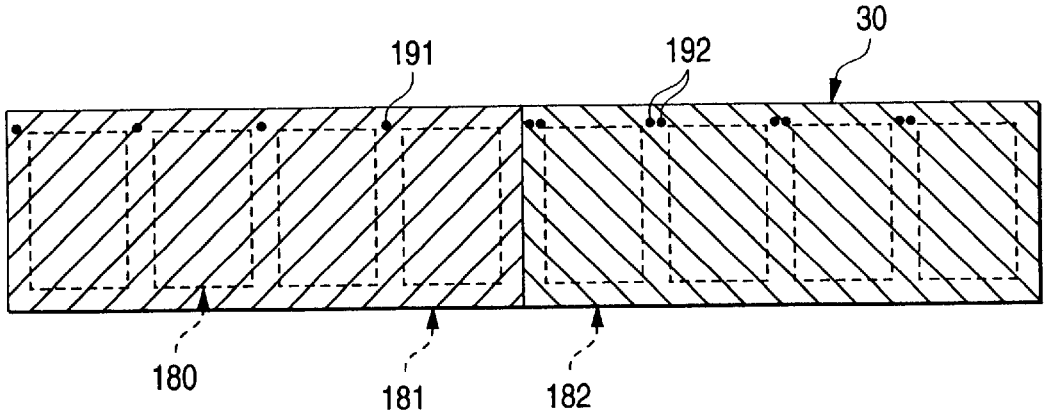
FIG. 15A is an explanatory view showing a structural example of an intermediate transfer belt used in the embodiment.

Particularly, in this embodiment, as shown in FIG. 14 and FIG. 15A, plural image transfer surfaces 180 subjected to different gloss processing are arranged on the surface of the intermediate transfer belt 30.

For example, in this embodiment, providing that, for example, eight image transfer surfaces 180 of A4 size are arranged, and two kinds of different glosses are used, for example, image transfer surfaces 181 subjected to high gloss processing are continuously arranged for four surfaces, and subsequently, image transfer surfaces 182 subjected to low gloss processing are continuously arranged for four surfaces.

Here, the high gloss processing means that for example, after silicon rubber is uniformly coated on the surface of the intermediate transfer belt 30, flat surface finishing equivalent to the surface property of a coater for coating the silicon rubber is made without adding any work. On the other hand, the low gloss processing means that for example, after silicon rubber is uniformly coated on the surface of the intermediate transfer belt 30, for example, a plate having minute protrusions on its surface, a plate having a grained surface, or the like is used to finish so that the surface of the flat silicon rubber is made to have irregularity.

Incidentally, the arrangement is not limited to this, but any pattern, such as every two surfaces or random pattern, may be used. In view of print speed, it is preferable to arrange the same gloss surfaces continuously.

Besides, the region of different gloss has only to coincide with at least the length of the printable maximum recording medium size in this image forming apparatus.

Besides, in this embodiment, correspondingly to the processing of the respective gloss, position markers 191 and 192 are disposed at sides of the respective image transfer surfaces 181 and 182. Here, one position marker 191 is disposed for the high gloss image transfer surface 181, and two position markers 192 are provided for the low gloss image transfer surface 182. Reference numeral 190 designates a position sensor for detecting the position markers 191 and 192.

Figure 16:
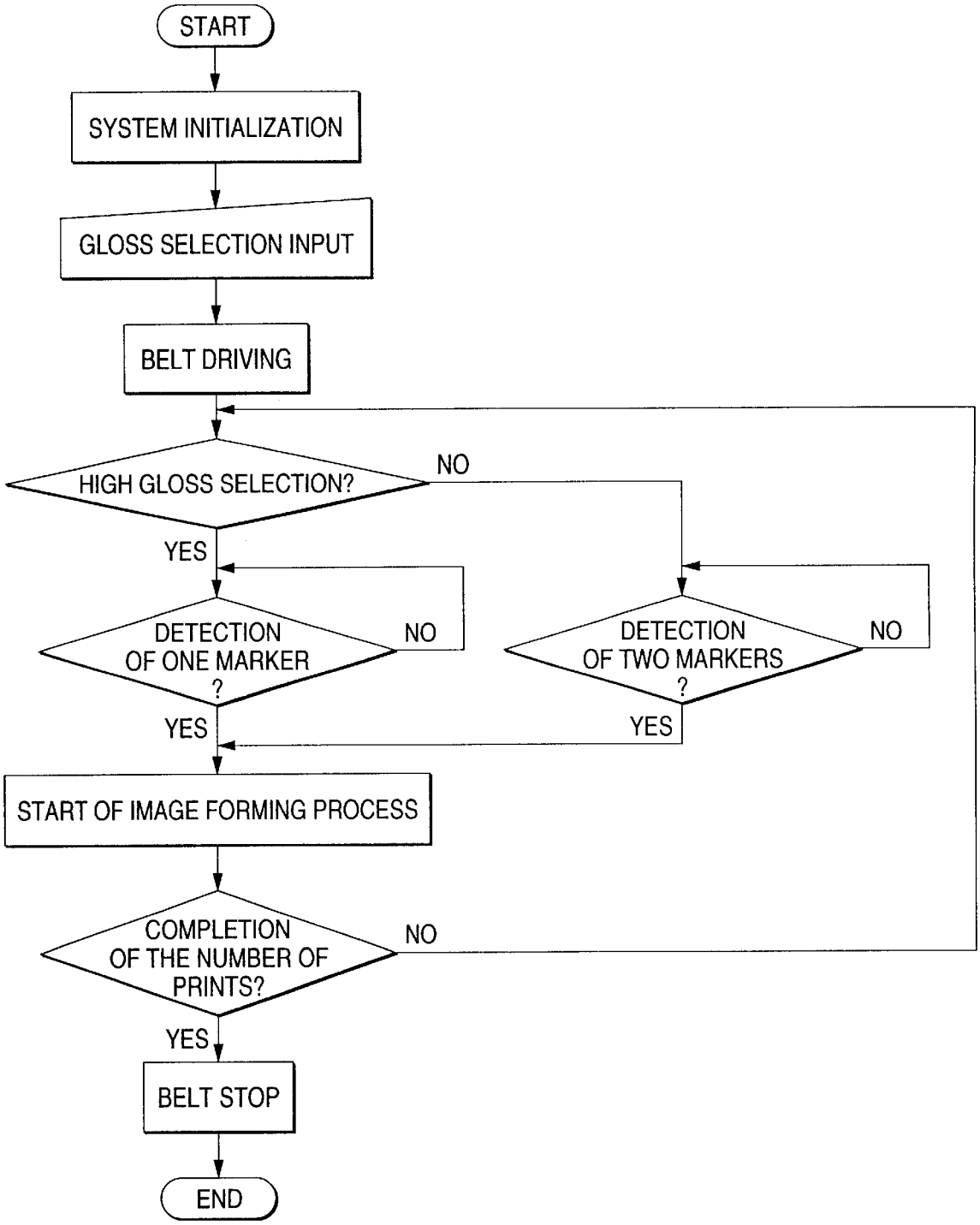
FIG. 16 is a flowchart showing processing contents of an image forming control system of the embodiment

Further, in this embodiment, a control device 200 performs processing shown in FIG. 16 in accordance with a selection signal from a gloss selection switch 201, sends a predetermined control signal to a driving motor 202, and performs image forming processing which corresponds to a selected gloss.

Next, the operation of the image forming apparatus of this embodiment will be described.

When a power source of a machine is turned on, the system is first initialized. Next, the user selects a desired number of prints and high gloss or low gloss (operating the gloss selection switch 201), and makes printing start.

Then, the intermediate transfer belt 30 is driven like an arrow. Then, the position markers 191 and 192 added onto the intermediate transfer belt 30 pass through the position under the position sensor 190, and the system can recognize which image transfer surface 181, 182 passes through.

The system judges whether the gloss selection input of the user is high gloss or low gloss.

At this time, if it is the high gloss, the belt is driven until the position sensor 190 detects one position marker 191.

For example, by regulating a time when the position sensor 190 detects a pair of markers, even if the first one of the two position markers 192.is detected, erroneous recognition of one or two markers does not occur.

On the other hand, even if the user selects the low gloss, this time, the system similarly waits until the two position markers 192 are detected.

When this detection is ended, the system starts a series of operations of xerography.

In this way, it is possible to supply a print image of user's desire at the gloss desired by the user.

If the number of prints does not reach the desired number, the system returns to the gloss judgement, waits for the next detection of the position markers 191, 192, and repeats the same operation until the number of prints reaches the number set by the user.

When the number of prints reaches what is set by the user, the completion of output of the print is confirmed by a sensor not shown here, and the system stops driving of the intermediate transfer belt 30.

Figure 15B:
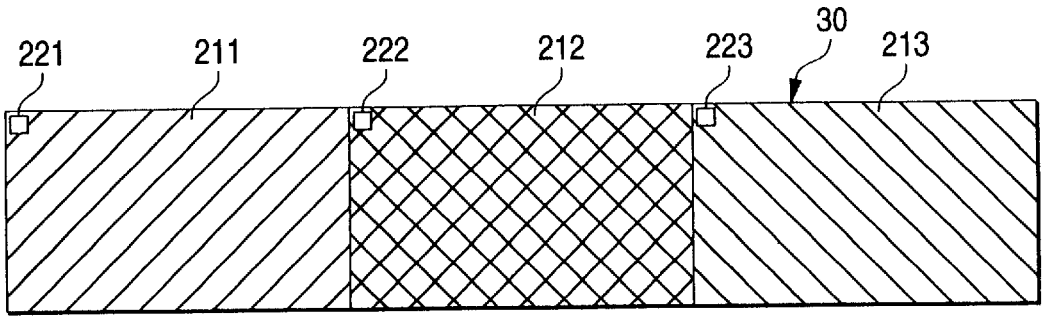
FIG. 15B is an explanatory view showing a structural example of an intermediate transfer belt used in a modified embodiment.

Incidentally, the intermediate transfer belt 30 having the different gloss image transfer surfaces 180 is not limited to this embodiment, but the design may be suitably changed. For example, as shown in FIG. 15B, the surface of the intermediate transfer belt 30 is divided into three different gloss regions, for example, a high gloss region 211 where the gloss is set rather high, a low gloss region 212 where the gloss is set rather low, and a standard gloss region 213 where the gloss is set standard, and markers 221 to 223 for head detection are disposed at head portions of the previously arranged regions 211 to 213 having three kinds of gloss so that the system (controller) can detect the regions 211 to 213 where the gloss is changed.

EXAMPLE 1

An example of the image forming apparatus of the embodiment 1 will be described.

Example of Basic Structure of Image Forming Apparatus

As basic elements of the image forming apparatus shown in FIG. 4, the following were adopted.

As the toner used for the developing device 24, there is cited polyester toner having weight average molecular weight (Mw) of 54000, melting point (Tmt) of 113° C., and average particle diameter of 7 $\mu$m.

Besides, the exposure condition or developing condition is set so that the amount of respective color toner on the recording medium 40 becomes approximately 0.4 mg/cm$^2$ to 7 mg/cm$^2$ according to the pigment content. In this example, the toner amount of respective color was made 0.55 mg/cm$^2$.

Besides, as the recording medium 40, Raicho dullart paper (made by Oji Paper Co., Ltd.) with weighing of 209 g/m$^2$, which is commercially available coat paper, is used as a base member, and what is obtained by coating a polyester resin of a thickness of 10 $\mu$m on its surface is used.

Further, as the intermediate transfer belt 30, a two-layer structure of a base layer and a surface layer was used.

As the base layer, a polyimide film having a thickness of 80 $\mu$m added with carbon black was used. The volume resistivity was adjusted to $10^{10}$ Ωcm by changing the addition amount of carbon black.

On the other hand, as the surface layer, in order to transfer the toner image from the photoreceptor drum 21 to the intermediate transfer belt 30 without electrostatic image disturbance, the volume resistivity is adjusted to $10^{14}$ Ωcm. Besides, in order to raise the adhesion between the intermediate transfer belt 30 and the recording medium 40 in the state where the toner image is nipped at the time of transfer from the intermediate transfer belt 30 to the recording medium 40, silicon copolymer having a rubber hardness of 40 degrees and a thickness of 50 $\mu$m is used. The surface of silicon copolymer shows viscosity to toner at room temperature, and further, the surface of silicon copolymer has characteristics to easily release the melted and fluidized toner, so that it is optimum for effectively shifting the toner to the recording medium 40.

Structure of Transfer Fixing Portion

Each of the pressing rolls 51 (511, 512) and 52 (521, 522) was an aluminum pipe coated with silicon rubber, and the diameter was 50 mm. The four structure pressing rolls 51 and 52 were disposed horizontally.

Among the pressing rolls 51 and 52, the rolls except for the outer roll 512 of the inlet side pressing rolls 51 were made heating rolls, kortz lamps (halogen lamps) were disposed as the heating sources 61 and 63 in the inside of the heating rolls, and with respect to the heating temperature, the parameters were optimized in view of speed.

On the other hand, as the heating plate 65, a rubber heater was attached to an aluminum plate and heating was made. The heating temperature was set and controlled to a temperature where the toner on the intermediate transfer belt 30 was sufficiently softened/melted.

Here, as specific heating conditions, under the standard condition of 30 mm/s, the set temperature of the heating plate 65 was made 155° C., the set temperature of the inner roll of the inlet side pressing rolls 51 was made 155° C., the set temperature of the inner roll 521 of the outlet side pressing rolls 52 was 155° C., and the set temperature of the outer roll 522 was made 95° C.

The standard of the set temperature was set such that the surface temperature of the recording medium 40 was made 125±5° C. by simulation, and the equilibrium temperature (calculated by simulation) at the roll nip for every process speed become a toner temperature of 130° C.±5° C. Although toner embedding can also be made by other parameters, basically, it is the point that the temperature in the nip is the melting temperature or less (viscosity is $10^4$ Pa·s or less).

The distance between the pressing rolls 51 and 52 was made 60 mm, the nip pressure of the inlet side pressing rolls 51 was made 1.8 kg/cm$^2$, and the nip pressure of the outlet side pressing rolls 52 was made 7.2 kg/cm$^2$.

Further, the entrance angle of the recording medium 40 was made −30 degrees with respect to the horizontal.

Operation and Performance Evaluation

As indices of evaluating the aim of the present invention [thick resin coated recording medium having large heat capacity is transferred and fixed at high speed while high picture quality is maintained], (1) embedded level of toner and (2) defect (surface bubble, graininess, blister) were evaluated.

Figure 17A:
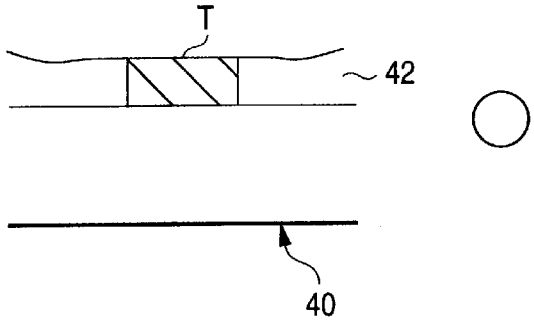
FIGS. 17A to 17C are explanatory views showing embedded levels of toner into a thermoplastic resin layer in an example.
Figure 17B:
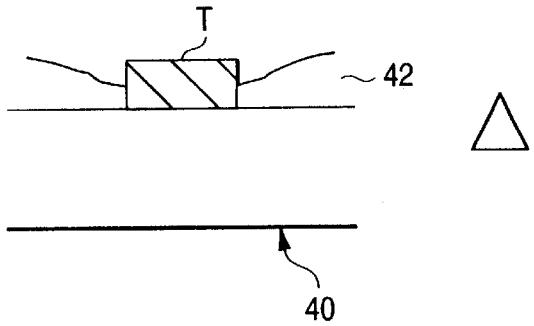
Figure 17C:
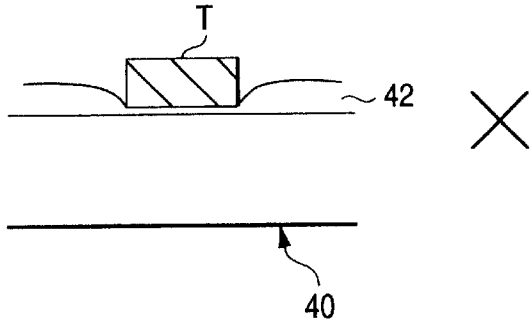
Figure 18:
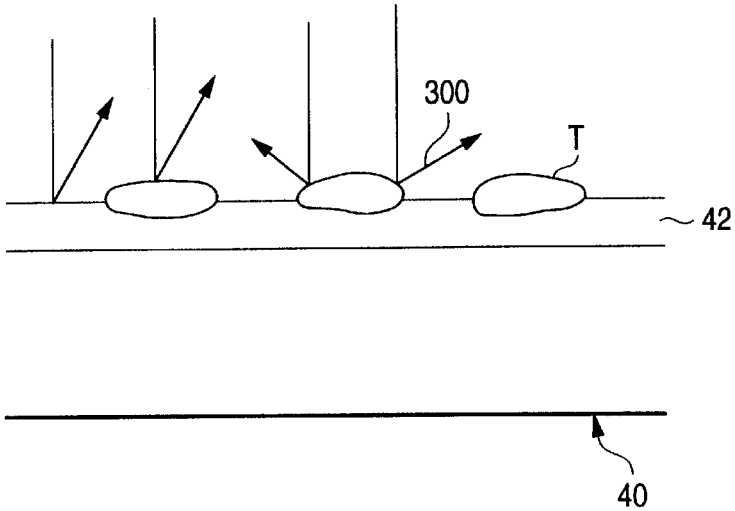
FIG. 18 is an explanatory view showing a scattered state by an embedding defect of toner on a recording medium.

FIGS. 17A to 17C show grades of embedded levels of toner. As the toner image is completely embedded in the thermoplastic resin layer 42 of the recording medium 40, the grade becomes excellent.

The X level (see FIG. 17C) in a highlight portion causes scattering of light 300 as shown in Pig. 18, and causes deterioration of a glossy feeling.

With respect to the surface bubble and blister, an outputted image was observed visually and was judged. With respect to the graininess, a gray image by a microphotometer was subjected to two-dimensional Fourier transform, a VTF (visual filter) was used to obtain a numerical value as so-call granularity, and judgement was made.

In the experiment, a mode of two pairs of pressing rolls of the present example was compared with a mode of one pair of pressing rolls of a comparative example.

Experimental Condition

Comparative Example (one pair of pressing rolls):

Temperature of the heating plate (silicon rubber heater) was 185° C.

Temperature of the inner roll of the pressing rolls was 185° C., and temperature of the outer roll was 90° C.

Nip pressure was a load of 7.2 kg/cm$^2$.

Present Example (two pairs of pressing rolls):

Heating plate (silicon rubber heater) temperature was 155° C.

Temperature of the inner roll of the inlet side pressing rolls was 155° C.

Nip pressure was a load of 1.8 kg/cm$^2$.

Temperature of the inner roll of the outlet side pressing rolls was

155° C., temperature of the outer roll was 90° C., and nip pressure was 7.2 kg/cm$^2$.

Distance between the pressing rolls was 60 mm

Common Condition

The recording medium 40 was made of Raicho dullart paper 209 g/m$^2$ coated with polyester resin of 10 $\mu$m and had an A-size (pattern physical patch), and was sent from a not-shown feeder at process speeds of 5, 30, 90, 150, 210, and 260 mm/s.

Figure 19:
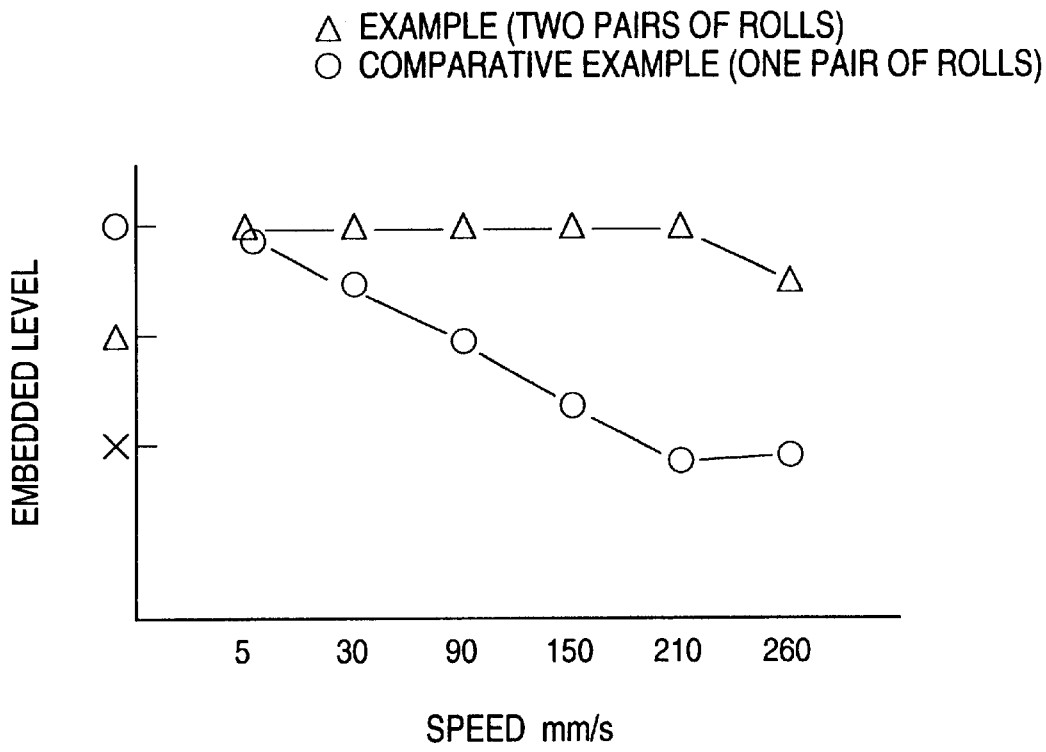
FIG. 19 is a graph in which the speed dependency of embedded level of toner in the example is studied.

FIG. 19 shows evaluation results of embedding of toner.

In the comparative example, although the temperature was set high (185° C.), as the speed is raised, heat supply to the thermoplastic resin layer becomes insufficient, and the embedded state of toner becomes deteriorated.

On the other hand, in the present example, embedding of toner up to the process speed of 210 mm/s is excellent, and becomes slightly worse from 260 mm/s. In order to improve the embedding property at a higher process speed, it has been found that if a temperature set value is further raised, it becomes excellent, and it has become apparent that the embedding capacity by this system is high.

Figure 20:
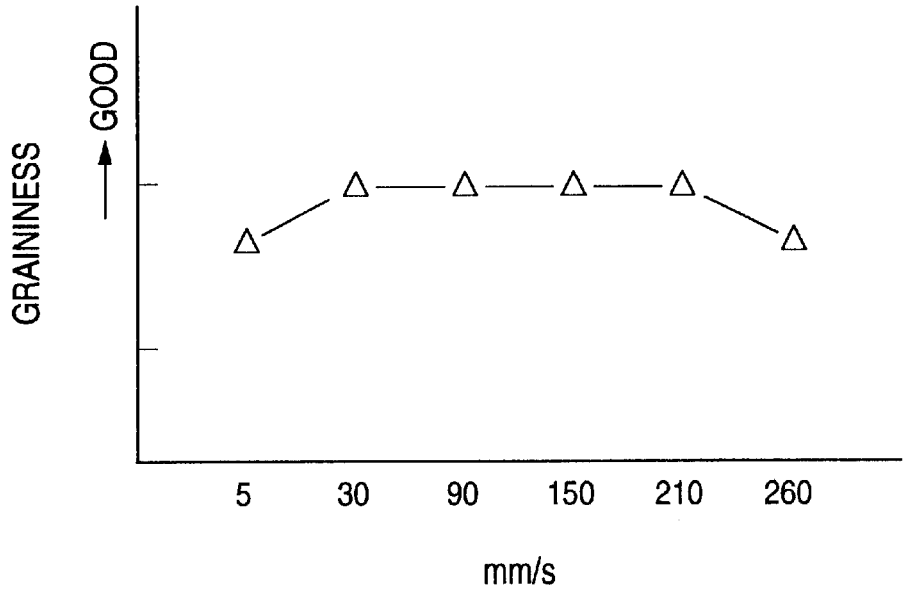
FIG. 20 is a graph in which the speed dependency of graininess in the example is studied.

FIG. 20 shows granularity evaluation results at a magenta patch of input concentration Cin 30%.

In the drawing, it becomes slightly worse at 5 mm/s because of the influence of a toner flow by excessive hear. Besides, although it becomes slightly worse at 260 mm/s because of the deterioration of an embedded state, it is understood that the deterioration of graininess at high speed in this system is very low.

Figure 21:
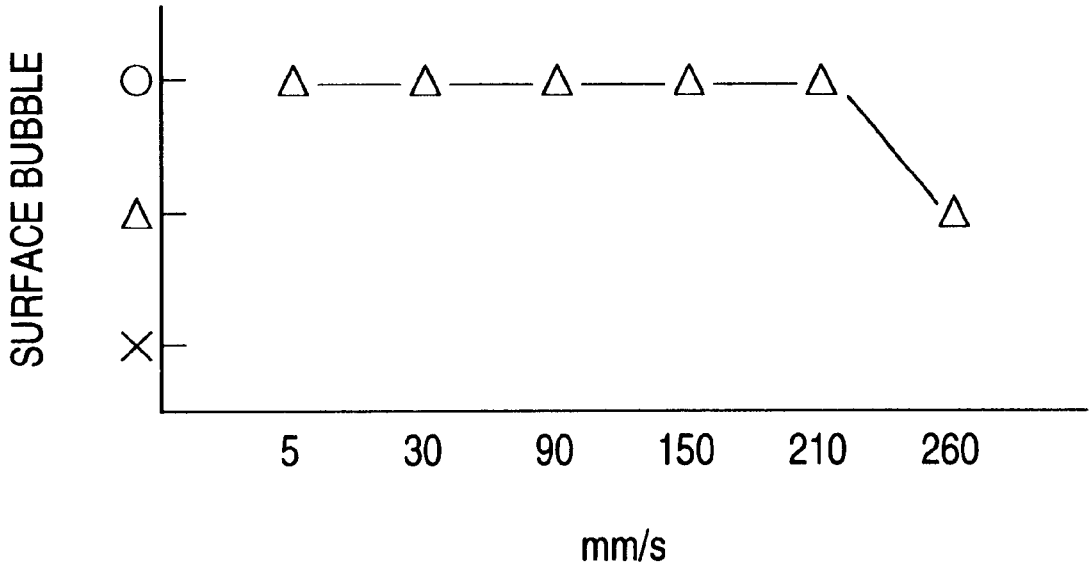
FIG. 21 a graph in which the speed dependency of surface bubble formation in the example is studied.

FIG. 21 shows results of observations of the generation state of surface bubbles.

In the drawing, although generation of surface bubbles starts at 260 mm/s, bubbles were not generated up to 200 mm/s under this condition.

Besides, the blister due to bubbles from the base member of the recording medium 40 was not generated under all experimental conditions.

EXAMPLE 2

An example of the image forming apparatus of the embodiment 2 will be described.

Example of Basic Structure of Image Forming Apparatus

In this example, polyester toner having weight average molecular weight (Mw) of 54000, melting point (Tmt) of 113° C., and average particle diameter of 7 $\mu$m was used. Besides, the exposure condition or developing condition is set so that the amount of respective color toner on the recording medium 40 becomes approximately 0.4 mg/cm$^2$ to 0.7 mg/cm$^2$ according to the pigment content. In this example, the respective color toner amount was set 0.65 mg/cm$^2$.

Besides, as the recording medium 40, enamer coat paper (Yonago Kakoshi Co., Ltd.) with weighing of 127.9 g/m$^2$, which is commercially available cast coat paper, is used as the base member, and what is obtained by coating polyester resin of a thickness of 7 $\mu$m on its surface is used.

Further, as the intermediate transfer belt 30, a two-layer structure of a base layer and a surface layer was used.

As the base layer, a polyimide film having a thickness of 70 $\mu$m and added with carbon black was used. The volume resistivity was adjusted to $10^{10}$ Ωcm by changing the addition amount of carbon black.

On the other hand, as the surface layer, in order to transfer the toner image from the photoreceptor drum 21 to the intermediate transfer belt 30 without electrostatic image disturbance, its volume resistivity was adjusted to $10^{14}$ Ωcm. Besides, in order to improve the adhesion between the intermediate transfer belt and the recording medium in the state where the toner image is nipped therebetween at the time of performing transfer and simultaneous fixing from the intermediate transfer belt to the recording medium, silicon copolymer having a rubber hardness of 40 degrees and a thickness of 50 $\mu$m was used.

Example of Structure of Transfer Fixing Portion

In this example, the size of the heating roll and the pressure roll was ϕ50 mm, and the position of the facing roll 123 was made a position upstream by about 20 mm in the moving direction of the intermediate transfer belt 30 on the periphery of the heating roll 121 from the nip region where the heating roll 121 is in contact with the pressure roll 122.

The moving speed of the intermediate transfer belt 30 is 160 mm/s, and before heating and pressing is made by the heating roll 121 and the pressure roll 122, the intermediate transfer belt 30 is in close contact with the recording medium 40 for about 0.12 second.

At this time, when the heating plate 125 and the heating roll 121 are set and controlled to a temperature of 175° C. to 155° C., before heating and pressing is made by the heating roll 121 and the pressure roll 122, the toner temperature becomes about 135° C. from 145° C., the surface temperature of the thermoplastic resin layer 42 on the recording medium 40 becomes about 125° C. from 135° C., and temperatures of both the toner and the thermoplastic resin layer 42 become the respective melting temperatures or higher.

In this example, the temperatures of the respective heating sources and the position of the facing roll 123 are determined so that the temperatures of both the toner and the thermoplastic resin layer 42 become their respective melting temperatures or higher before heating and pressing is made by the heating roll 121 and the pressure roll 122. However, in the case where the speed of the intermediate transfer belt 30 is slower than this example, or in the case where a time when heating and pressing is made by the heating roll 121 and the pressure roll 122 is longer than this example, it is not always necessary that the temperatures of both the toner and the thermoplastic resin layer 42 become their respective melting temperatures before they are heated and pressed by the heating roll 121 and the pressure roll 122.

As described above, according to the transfer fixing device of the present invention, the press conveying mechanism and the heat supply adjusting mechanism are used, or the preheating mechanism and the heating and pressing mechanism are used, so that heat can be supplied for a long time to the unfixed image of the image bearing and conveying body and the thermoplastic resin layer of the recording medium. Thus, even if the thick resin coated recording medium having large heat capacity is used and transferring/fixing is performed at high speed, the fixed image sufficiently sinks in the thermoplastic resin layer of the recording medium, plane smoothness of the fixed image can be secured, and high picture quality without defects of picture quality, such as blister, can be maintained.

Thus, the thick resin coated recording medium having large heat capacity is used, and transferring and fixing can be performed at high speed while surface gloss is high, minute irregular gloss does not occur, a glossy feeling is excellent, and high picture quality is maintained.

Besides, in the image forming apparatus provided with such transfer fixing device, a picture image having an excellent gloss feeling and high quality can be obtained at high speed.

Further, according to the image bearing and conveying body of the present invention, since such a structure is adopted that a gloss desired by the user can be selected, an image forming cycle using the corresponding gloss surface can be easily realized.

Thus, according to the image forming apparatus provided with such image bearing and conveying body, by suitably selecting the gloss surface on the image bearing and conveying body, a picture image having a gloss close to one desired by the user can be easily obtained.

What is claimed is:

1. An apparatus, comprising:

an image bearing and conveying body which is configured to bear and convey an unfixed image to be transferred and fixed to a thermoplastic resin layer on a surface of a recording medium by a transfer fixing device, the image bearing and conveying body being disposed in contact with the recording medium through the unfixed image; and wherein the image bearing and conveying body includes plural kinds of gloss surfaces that correspond to regions of different surface roughness.

2. An image bearing and conveying body which bears and conveys an unfixed image to be transferred and fixed to a thermoplastic resin layer on a surface of a recording medium by a transfer fixing device, the image bearing and conveying body being disposed in contact with the recording medium through the unfixed image, comprising:

plural kinds of gloss surfaces located at the image bearing and conveying body and that correspond to regions of different surface roughness; and a region of each of the plural kinds of gloss surfaces being set correspondingly to the recording medium of a usable maximum size.

3. An image forming apparatus comprising:

an image bearing and conveying body which bears and conveys an unfixed image to be transferred and fixed to a thermoplastic resin layer on a surface of a recording medium by a transfer fixing device, the image bearing and conveying body being disposed in contact with the recording medium through the unfixed image;

plural kinds of gloss surfaces located at the image bearing and conveying body and that correspond to regions of different surface roughness;

a gloss section switch selecting one from plural gloss surfaces on the image bearing and conveying body; and an image forming control device executing an image forming cycle using the gloss surface selected by the gloss selection switch.

* * * * *